US008826592B2

(12) United States Patent
Katayama et al.

(10) Patent No.: US 8,826,592 B2
(45) Date of Patent: Sep. 9, 2014

(54) WINDOW REGULATOR DEVICE

(75) Inventors: Hidefumi Katayama, Anjo (JP); Ryoichi Fukumoto, Nagoya (JP); Ryujiro Akizuki, Kariya (JP); Koichi Hirota, Takahama (JP)

(73) Assignee: Aisin Seiki Kabushiki Kaisha, Kariya-shi (JP)

( * ) Notice: Subject to any disclaimer, the term of this patent is extended or adjusted under 35 U.S.C. 154(b) by 0 days.

(21) Appl. No.: 13/497,990

(22) PCT Filed: Sep. 15, 2010

(86) PCT No.: PCT/JP2010/065971

§ 371 (c)(1),
(2), (4) Date: Mar. 23, 2012

(87) PCT Pub. No.: WO2011/040246

PCT Pub. Date: Apr. 7, 2011

(65) Prior Publication Data

US 2012/0198770 A1 Aug. 9, 2012

(30) Foreign Application Priority Data

Sep. 29, 2009 (JP) ..... 2009-224365
Sep. 29, 2009 (JP) ..... 2009-224392

(51) Int. Cl.
*E05F 15/16* (2006.01)

(52) U.S. Cl.
USPC ..... 49/26; 49/351; 49/349; 49/28

(58) Field of Classification Search
USPC ..... 49/348, 349, 351, 26, 27, 28
See application file for complete search history.

(56) References Cited

U.S. PATENT DOCUMENTS

| | | | | | |
|---|---|---|---|---|---|
| 3,471,969 | A | * | 10/1969 | Littmann | 49/28 |
| 4,159,598 | A | * | 7/1979 | Gatland et al. | 49/28 |
| RE34,287 | E | * | 6/1993 | Berner et al. | 49/322 |
| 5,689,160 | A | * | 11/1997 | Shigematsu et al. | 318/281 |
| 6,181,094 | B1 | * | 1/2001 | Menke | 318/434 |

FOREIGN PATENT DOCUMENTS

| | | | |
|---|---|---|---|
| CN | 2726934 | Y | 9/2005 |
| CN | 2769453 | Y | 4/2006 |
| CN | 201024825 | Y | 2/2008 |
| JP | 60 78082 | | 5/1985 |
| JP | 7 18864 | | 5/1995 |
| JP | 09-184359 | | 7/1997 |
| JP | 11 268532 | | 10/1999 |

OTHER PUBLICATIONS

International Search Report issued Dec. 21, 2010, in PCT/JP10/65971 filed Sep. 15, 2010.
Combined Office Action and Search Report issued Mar. 1, 2013 in Chinese Patent Application No. 201080043633.0 with English language translation.

* cited by examiner

*Primary Examiner* — Gregory J Strimbu
(74) *Attorney, Agent, or Firm* — Oblon, Spivak, McClelland, Maier & Neustadt, L.L.P.

(57) ABSTRACT

A window regulator device including an object pinching detection unit which includes an input-side rotational member; an output-side rotational member coupled to an output shaft; an elastic member interposed between the input-side rotational member and the output-side rotational member; a cam formed respectively on opposed surfaces of the input-side rotational member and the output-side rotational member; and an object pinching detection switch for performing a switching operation based on the axial movement of the output-side rotational member.

9 Claims, 20 Drawing Sheets

WINDOW REGULATOR DEVICE

TECHNICAL FIELD

The present invention relates to a window regulator device for automatically opening and closing a window glass of a vehicle by a force that is generated by a power source such as an electric motor. In particular, the present invention relates to a window regulator device including object pinching detection means for detecting pinching of a foreign object when the foreign object is pinched between a window glass and a window frame.

BACKGROUND ART

Conventionally, window glasses mounted onto a side window, a roof window, and the like of a vehicle are manually opened and closed, but currently, most window glasses of a vehicle are automatically opened and closed by a force that is generated by a power source such as an electric motor. When the window glass is automatically closed, a foreign object may be pinched between the window glass and the window frame. There has already been developed a window regulator device having an anti-pinch function, in which when the pinching of the foreign object is detected, an operation of the window glass in a closing direction (closing operation) is stopped, or an operation direction of the window glass is reversed, to thereby eliminate the pinching.

The window regulator device having the anti-pinch function includes object pinching detection means for detecting the pinching of the foreign object. The object pinching detection means equipped in the window regulator device described in Japanese Utility Model Examined Publication No. Hei 7-18864 includes an input-side rotator rotatable by a rotational drive force of a drive motor serving as a power source for opening and closing the window glass, a disk-like contact element arranged so as to be rotatable integrally with the input-side rotator and axially movable, an output-side rotator placed between the input-side rotator and the contact element, and a contact point member arranged to be opposed to the contact element. The output-side rotator is rotated by a rotational drive force to be received from the input-side rotator via coil springs. Further, protrusions are formed on a surface of the output-side rotator facing the contact element, and through-holes for fitting the protrusions therein are formed in the contact element. When the contact element rotates along with the rotation of the input-side rotator, the protrusions are fitted into the through-holes so that the output-side rotator rotates integrally with the contact element.

When the foreign object is pinched between the window glass and the window frame, a rotation speed of the output-side rotator decreases, and hence the contact element rotates relative to the output-side rotator. Through the relative rotation, the protrusions formed on the output-side rotator push up the contact element. Therefore, the contact element axially moves while rotating. Through the axial movement of the contact element, switch brushes formed on the contact element are brought into contact with a conductive member formed on the contact point member. Through the contact between the switch brushes and the conductive member, the pinching is detected.

Further, Japanese Patent Application Laid-open No. Sho 60-78082 discloses a window regulator device, in which the window glass is automatically operated in an opening direction (opened) when the foreign object is pinched between the window glass and the window frame. According to the window regulator device described in Japanese Patent Application Laid-open No. Sho 60-78082, when an open/close position of the window glass during raising (closing) of the window glass is situated within a predetermined positional area that is set in advance and when the foreign object is pinched between the window glass and the window frame, the anti-pinch processing is executed so that the window glass is lowered (opened).

CITATION LIST

Patent Literature

[PTL 1] Japanese Utility Model Examined Publication No. Hei 7-18864

[PTL 2] Japanese Patent Application Laid-open No. Sho 60-78082

SUMMARY OF INVENTION

Technical Problems

According to the object pinching detection means described in Japanese Utility Model Examined Publication No. Hei 7-18864, at the time of pinching of the foreign object, the switch brushes formed on the contact element are brought into contact with the conductive member formed on the contact point member while the contact element is rotating, and hence object pinching detection accuracy deteriorates due to wear of the switch brushes and the conductive member. Further, the conductive member is formed into a ring shape along a rotational direction of the switch brushes, and hence the conductive member is large in size. Further, at the time of pinching of the foreign object, the contact element is pushed up while rotating, and hence the contact element may be inclined relative to the axial direction when the contact element is pushed up. The inclination leads to instability of the contact state between the switch brushes and the conductive member, with the result that the object pinching detection accuracy further deteriorates.

The present invention has been made to solve the above-mentioned problems, and it is therefore an object of the present invention to provide a window regulator device including object pinching detection means, in which deterioration in object pinching detection accuracy is suppressed.

Solution to Problems

The present invention discloses a window regulator device, including: a power source; an output shaft connected to the power source and rotatable by a force generated by the power source; a drive force transmission mechanism for transmitting a rotational drive force of the output shaft to a window glass of a vehicle so as to open and close the window glass by the rotational drive force of the output shaft; and object pinching detection means for detecting whether or not a foreign object is pinched between the window glass and a window frame. The object pinching detection means includes: an input-side rotational member rotatable by the force of the power source; an output-side rotational member, which is coupled to the output shaft so as to be integrally rotatable and axially movable and is arranged coaxially with the input-side rotational member so as to face the input-side rotational member; an elastic member interposed between the input-side rotational member and the output-side rotational member so as to transmit a rotational drive force of the input-side rotational member to the output-side rotational member when the input-side rotational member rotates in one rotational direction; cam means formed respectively on opposed surfaces of the input-side rotational member and the output-side rotational member so that, when the input-side rotational member rotates in the one rotational direction relative to the output-side rotational member, the output-side rotational member is axially movable along with relative rotation of the input-side rotational member to the output-side rotational member; and an object pinching detection switch for performing a switching operation based on axial movement of the output-side rotational member.

According to the present invention, when the input-side rotational member rotates in the one rotational direction by the force of the power source, the rotation of the input-side rotational member is transmitted to the output-side rotational member via the elastic member, and the output-side rotational member also rotates. Through the rotation of the output-side rotational member, the output shaft, to which the output-side rotational member is coupled so as to be integrally rotatable, also rotates. The rotation of the output shaft is transmitted to the window glass by the drive force transmission mechanism, and accordingly the window glass is opened and closed.

When the foreign object is pinched between the window glass and the window frame, the operation of the window glass is stopped due to the pinching of the foreign object. The rotation of the output shaft is also stopped in association with the stop of operation of the window glass. Along with the stop of rotation of the output shaft, the rotation of the output-side rotational member, which is coupled to the output shaft so as to be integrally rotatable, is also stopped. However, the input-side rotational member continues to rotate by the force of the power source. Therefore, the input-side rotational member rotates relative to the output-side rotational member while compressing the elastic member. At this time, the output-side rotational member axially moves by the cam means formed respectively on the opposed surfaces of the input-side rotational member and the output-side rotational member. Based on the axial movement of the output-side rotational member, the object pinching detection switch is operated. Based on a change in switching state of the object pinching detection switch that is caused by such an operation, the pinching of the foreign object is detected.

As described above, according to the object pinching detection means mounted onto the window regulator device of the present invention, the output-side rotational member, which is axially movable in association with pinching when the foreign object is pinched between the window glass and the window frame, is coupled on the output shaft side. Therefore, when the pinching has occurred, the output-side rotational member stops its rotation in association with the stop of rotation of the output shaft. Then, the output-side rotational member axially moves without rotation by an action of the cam means. Thus, wear due to rotation of the output-side rotational member or the like does not occur when the object pinching detection switch performs the switching operation based on the axial movement of the output-side rotational member. Accordingly, the deterioration in object pinching detection accuracy due to the wear is prevented. Further, the output-side rotational member axially moves without rotation, and hence the object pinching detection switch can be configured to perform the switching operation based only on a change of the output-side rotational member in the axial direction thereof. Thus, a compact object pinching detection switch can be obtained.

In the present invention, the electric motor may typically be employed as the "power source", but any power source may be employed as long as the power source can apply rotational torque to the output shaft. Further, a switch of any type may be employed as the "object pinching detection switch" as long as the switch is switchable between switching states (for example, ON state and OFF state) based on the axial movement of the output-side rotational member. For example, as the object pinching detection switch, there may be employed a contact point switch including a substrate, a conductive portion formed on the substrate, and a movable piece having a base end coupled to a part of the conductive portion and having a tip end spaced apart from the substrate. Further, the object pinching detection switch may be structured so that a movable contact point is mounted onto the output-side rotational member and only a fixed contact point is formed on the substrate of the object pinching detection switch.

The output-side rotational member may be coupled to the output shaft so that the entire output-side rotational member is axially movable, or alternatively, the output-side rotational member may be coupled to the output shaft so that only at least a part of the output-side rotational member is axially movable. For example, the output-side rotational member may be structured so that the output-side rotational member includes two rotators and one of the rotators is coupled to the output shaft so as to be integrally rotatable and axially immovable while another of the rotators is assembled to the one of the rotators so as to be integrally rotatable and axially movable.

Further, the window regulator device of the present invention may include, for example, an ECU for outputting an instruction signal for executing anti-pinch processing based on the switching state of the object pinching detection switch, but may omit such an ECU. In a case where the window regulator device includes such an ECU, the anti-pinch processing is executed based on the instruction signal output from the ECU. On the other hand, in a case where the window regulator device does not include such an ECU, the object pinching detection switch itself is integrated into a drive circuit for driving the power source such as an electric motor, and the energized/non-energized state of the power source is switched or the direction of energization of the power source is switched in accordance with the switching state of the switch. With the above-mentioned structure, the anti-pinch processing can be executed without using the ECU, and hence the window regulator device having the anti-pinch function can be manufactured at lower cost.

Further, it is preferred that the cam means includes: an input-side projection/recess portion (or convexo concave portion) formed into a projecting shape or a recessed shape along a circumferential direction of the input-side rotational member and provided on a surface of the input-side rotational member facing the output-side rotational member; and an output-side projection/recess portion (or convexo concave portion) formed into a projecting shape or a recessed shape along a circumferential direction of the output-side rotational member and provided on a surface of the output-side rotational member facing the input-side rotational member, and the input-side projection/recess portion and the output-side projection/recess portion be arranged and formed so as to engage with each other when the input-side rotational member rotates in the one rotational direction relative to the output-side rotational member. It is further preferred that at least one of the input-side projection/recess portion and the output-side projection/recess portion include an engagement surface inclined relative to the one rotational direction, the engagement surface being formed so that the output-side rotational member is axially movable when the input-side projection/recess portion and the output-side projection/recess portion engage with each other.

Accordingly, when the input-side rotational member rotates in one direction relative to the output-side rotational member, the input-side projection/recess portion formed on the input-side rotational member and the output-side projection/recess portion formed on the output-side rotational member engage with each other. At the time of engagement, the counterpart member moves while sliding along the engagement surface formed in one or both of the input-side projection/recess portion and the output-side projection/recess portion, and accordingly the output-side rotational member axially moves relative to the input-side rotational member. With this structure, the output-side rotational member can be axially moved reliably at the time of relative rotation.

In this case, it is preferred that a plurality of input-side projection/recess portions having the same shape are provided along the circumferential direction of the input-side rotational member, and a plurality of output-side projection/recess portions having the same shape are provided along the circumferential direction of the output-side rotational member, the plurality of output-side projection/recess portions being equal in number to the plurality of input-side projection/recess portions. It is further preferred that the plurality of input-side projection/recess portions and the plurality of output-side projection/recess portions be disposed so that, when the input-side rotational member rotates in the one rotational direction relative to the output-side rotational member, all the plurality of input-side projection/recess portions simultaneously engage with all the plurality of output-side projection/recess portions.

Accordingly, the plurality of input-side projection/recess portions provided to the input-side rotational member along the circumferential direction of the input-side rotational member simultaneously engage with the plurality of output-side projection/recess portions provided to the output-side rotational member along the circumferential direction of the output-side rotational member, and hence the output-side rotational member axially moves while maintaining the horizontal state without being inclined in the circumferential direction. Thus, it is possible to prevent instability of the switching operation of the object pinching detection switch, which may be caused by the inclination of the output-side rotational member, with the result that the deterioration in object pinching detection accuracy is further suppressed.

It is preferred that the plurality of input-side projection/recess portions be disposed at regular intervals in the circumferential direction of the input-side rotational member, and the plurality of output-side projection/recess portions be disposed at regular intervals in the circumferential direction of the output-side rotational member. By virtue of this configuration, at the time of engagement between the input-side projection/recess portions and the output-side projection/recess portions, the output-side rotational member axially moves at constant speed over the circumferential direction. Thus, the horizontal state of the output-side rotational member is maintained at the time of axial movement. Note that, it is preferred that three or more input-side projection/recess portions and three or more output-side projection/recess portions each be disposed at regular intervals in the circumferential direction. When the number of the respective projection/recess portions is three or more, the horizontal state of the output-side rotational member is reliably maintained at the time of axial movement.

Further, it is preferred that the input-side projection/recess portion and the output-side projection/recess portion be both formed into the projecting shape. Accordingly, when the input-side projection/recess portion and the output-side projection/recess portion engage with each other, the output-side projection/recess portion overrides the input-side projection/recess portion while sliding along the engagement surface, and accordingly the output-side rotational member axially moves so as to be spaced apart from the input-side rotational member. Based on the movement in this direction, the pinching is detected.

Further, it is preferred that the output-side rotational member includes: a driven plate, which is coupled to the output shaft so as to be integrally rotatable and axially immovable and is configured to receive the rotational drive force of the input-side rotational member via the elastic member when the input-side rotational member rotates in the one rotational direction; and an object pinching detection plate coupled to the driven plate so as to be integrally rotatable and axially movable. It is further preferred that the output-side projection/recess portion be formed on the object pinching detection plate. By virtue of this configuration, when the input-side rotational member rotates in the one rotational direction, the rotational drive force of the input-side rotational member is transmitted to the driven plate via the elastic member, and therefore the driven plate rotates. The rotation of the driven plate is transmitted to the output shaft and the object pinching detection plate, and therefore those components integrally rotate. Further, when the pinching is detected, the rotation of the output shaft, the driven plate, and the object pinching detection plate is stopped. At this time, through the engagement between the input-side projection/recess portion formed on the input-side rotational member and the output-side projection/recess portion formed on the object pinching detection plate, only the object pinching detection plate axially moves. Based on the axial movement of the object pinching detection plate, the pinching is detected.

Further, it is preferred that the input-side rotational member includes a worm wheel fitted into a worm rotatable by the force of the power source. It is further preferred that the input-side projection/recess portion be formed on the worm wheel. Accordingly, the force of the power source is reduced by a worm reduction mechanism formed of the worm and the worm wheel, and reduced rotation is transmitted to the output-side rotational member.

Further, it is preferred that the object pinching detection switch includes a fixed contact point and a movable contact point, and be disposed at such a position that a contact state between the movable contact point and the fixed contact point changes depending on the axial movement of the output-side rotational member. Accordingly, the simple object pinching detection switch including the movable contact point and the fixed contact point enables the detection of the pinching based on the axial movement of the output-side rotational member.

It is preferred that the power source be an electric motor including a first electric power supply terminal and a second electric power supply terminal, the electric motor being configured to generate a drive force for opening and closing the window glass through energization between the first electric power supply terminal and the second electric power supply terminal. In this case, it is preferred that the window regulator device further includes a drive circuit connected to the electric motor and having formed therein an energization path from an electric power source to the electric motor. With this structure, the electric motor is driven by the electric power supplied via the energization path formed in the drive circuit.

In this case, it is preferred that the drive circuit includes a first switch contact point, a second switch contact point, a first latching relay, a second latching relay, a first relay line, a second relay line, a third relay line, and a fourth relay line. It is further preferred that the object pinching detection switch be interposed midway in the third relay line, and configured to perform the switching operation so as to be brought into a non-conductive state when the foreign object is not pinched between the window glass and the window frame and brought into a conductive state when the foreign object is pinched between the window glass and the window frame.

The first switch contact point includes: a first high voltage side input terminal connected to a positive terminal of the electric power source; a first low voltage side input terminal connected to a negative terminal of the electric power source; and a first output terminal to be selectively connected to the first high voltage side input terminal and the first low voltage side input terminal. The first switch contact point is configured so that the first high voltage side input terminal and the first output terminal are connected to each other when an operation position of an operation switch for operating opening and closing of the window glass is a window closing position, and the first low voltage side input terminal and the first output terminal are connected to each other when the operation position of the operation switch is a window opening position and when the operation switch is not operated.

The second switch contact point includes: a second high voltage side input terminal connected to the positive terminal of the electric power source; a second low voltage side input terminal connected to the negative terminal of the electric power source; and a second output terminal to be selectively connected to the second high voltage side input terminal and the second low voltage side input terminal. The second switch contact point is configured so that the second high voltage side input terminal and the second output terminal are connected to each other when the operation position of the operation switch is the window opening position, and the second low voltage side input terminal and the second output terminal are connected to each other when the operation position of the operation switch is the window closing position and when the operation switch is not operated.

The first latching relay includes: a first reverse rotation excitation coil and a first forward rotation excitation coil connected on one end sides thereof by a first connection lead wire; a first reverse rotation terminal connected to the second electric power supply terminal; a first forward rotation terminal connected to the first electric power supply terminal; a first movable terminal connected to the first output terminal; and a first movable piece configured to connect the first reverse rotation terminal and the first movable terminal to each other when the first reverse rotation excitation coil is energized, and connect the first forward rotation terminal and the first movable terminal to each other when the first forward rotation excitation coil is energized.

The second latching relay includes: a second reverse rotation excitation coil and a second forward rotation excitation coil connected on one end sides thereof by a second connection lead wire; a second reverse rotation terminal connected to the first electric power supply terminal; a second forward rotation terminal connected to the second electric power supply terminal; a second movable terminal connected to the second output terminal; and a second movable piece configured to connect the second reverse rotation terminal and the second movable terminal to each other when the second reverse rotation excitation coil is energized, and connect the second forward rotation terminal and the second movable terminal to each other when the second forward rotation excitation coil is energized.

The first relay line connects the first output terminal to the first connection lead wire and the second connection lead wire. The second relay line is connected to another end side of the first reverse rotation excitation coil and another end side of the second reverse rotation excitation coil. The third relay line connects the second relay line to the second output terminal. The fourth relay line connects the first output terminal to another end side of the first forward rotation excitation coil and another end side of the second forward rotation excitation coil.

According to the window regulator device including the above-mentioned drive circuit, when the operation position of the operation switch for operating opening and closing of the window glass is the window closing position, the first high voltage side input terminal and the first output terminal of the first switch contact point are connected to each other, and the second low voltage side input terminal and the second output terminal of the second switch contact point are connected to each other. Further, the first movable terminal of the first latching relay is connected to the first forward rotation terminal under a normal state (state in which the first forward rotation excitation coil is energized), and the second movable terminal of the second latching relay is connected to the second forward rotation terminal under the normal state. Thus, the positive terminal of the electric power source is connected to the first electric power supply terminal of the electric motor via the first switch contact point and the first latching relay. Further, the negative terminal of the electric power source is connected to the second electric power supply terminal of the electric motor via the second switch contact point and the second latching relay. Under the above-mentioned connection state, a current flows through the electric motor from the first electric power supply terminal toward the second electric power supply terminal, and therefore the electric motor rotates in one direction (for example, forward rotation direction). Through the rotation of the electric motor in the one direction, the window glass is closed.

Meanwhile, when the operation position of the operation switch is the window opening position, the first low voltage side input terminal and the first output terminal of the first switch contact point are connected to each other, and the second high voltage side input terminal and the second output terminal of the second switch contact point are connected to each other. Thus, the positive terminal of the electric power source is connected to the second electric power supply terminal of the electric motor via the second switch contact point and the second latching relay, and the negative terminal of the electric power source is connected to the first electric power supply terminal of the electric motor via the first switch contact point and the first latching relay. Accordingly, a current flows through the electric motor from the second electric power supply terminal toward the first electric power supply terminal, and therefore the electric motor rotates in another direction (for example, reverse rotation direction). Through the rotation of the electric motor in the another direction, the window glass is opened.

When the foreign object is pinched between the window glass and the window frame at the time of closing the window glass, the object pinching detection switch is brought into the conductive state (ON state). Accordingly, both ends of the third relay line are brought into conduction, and there is formed a relay circuit connecting the first output terminal, the first relay line, the first reverse rotation excitation coil and the second reverse rotation excitation coil, the second relay line, the third relay line, and the second output terminal. A current flows through the relay circuit, and accordingly the first reverse rotation excitation coil and the second reverse rotation excitation coil are energized. Through the energization of the first reverse rotation excitation coil, the first movable piece is operated so that the first reverse rotation terminal of the first latching relay is connected to the first movable terminal. Through the energization of the second reverse rotation excitation coil, the second movable piece is operated so that the second reverse rotation terminal of the second latching relay is connected to the second movable terminal. In this manner, the latching relays are switched.

Through the switching operation of the latching relays, the positive terminal of the electric power source is connected to the second electric power supply terminal of the electric motor via the first switch contact point and the first latching relay. Further, the negative terminal of the electric power source is connected to the first electric power supply terminal of the electric motor via the second switch contact point and the second latching relay. Thus, a current flows through the electric motor from the second electric power supply terminal toward the first electric power supply terminal, and therefore the electric motor rotates in the another direction (for example, reverse rotation direction). Through the rotation of the electric motor in the another direction, the window glass is opened. That is, when the pinching is detected, the window glass is opened even in a case where the operation position of the operation switch is the window closing position. Therefore, the pinching is eliminated.

As described above, the object pinching detection switch is integrated into the relay circuit, and the latching relays are switched based on the conductive state of the object pinching detection switch. Accordingly, without using the ECU or integrated circuit, the opening and closing operation of the window glass can be executed by the electric motor and the reverse operation can be executed by the electric motor at the time of anti-pinch processing.

According to the above-mentioned window regulator device described in Japanese Patent Application Laid-open No. Sho 60-78082, in order to perform the anti-pinch processing, an integrated circuit including a comparator, an AND element, an OR element, an inverter, and the like is used as the drive circuit of the electric motor. Therefore, the circuit structure becomes complicated and larger in size, and cost therefor is high. Even in a case of using a microcomputer such as a door ECU in order to perform the anti-pinch processing, cost therefor is similarly high. That is, in a case where the window regulator device having the anti-pinch function is manufactured by using the integrated circuit or ECU, the manufacturing cost is high. In contrast, according to the above-mentioned window regulator device of the present invention, the ECU or integrated circuit is not used. Therefore, the circuit structure is simple and the drive circuit is small in size. Further, the ECU or integrated circuit is not used, and hence the manufacturing cost for the drive circuit is low.

Note that, when the window glass is reversely operated (opened) through the detection of the pinching, the pinching is eliminated, and hence the object pinching detection switch is brought into the non-conductive state. Therefore, the above-mentioned relay circuit is not formed, and the energization of the first reverse rotation excitation coil and the second reverse rotation excitation coil is stopped. However, the first latching relay and the second latching relay maintain the switching states thereof even after the energization of the coils is stopped. Thus, even after the pinching is eliminated, the rotation of the electric motor in the another direction is maintained and thus the reverse operation (opening operation) of the window glass is continued.

Further, in a case where the latching relays are switched due to the pinching of the foreign object, when the operation switch is operated with their switching states unchanged, the opening and closing operation of the window glass is reversed. That is, when the operation position of the operation switch is the window closing position, the window glass is opened, and when the operation position of the operation switch is the window opening position, the window glass is closed. In this case, when the operation of the operation switch is stopped after the anti-pinch processing, for example, a different circuit only needs to be used for applying a predetermined voltage between both ends of the first forward rotation excitation coil and both ends of the second forward rotation excitation coil, to thereby energize those coils. Through this energization, the switching states of both the latching relays are recovered to the original normal state (the first forward rotation terminal and the first movable terminal of the first latching relay are connected to each other, and the second forward rotation terminal and the second movable terminal of the second latching relay are connected to each other). After the recovery of the switching states of both the latching relays, the window glass is closed when the operation position of the operation switch becomes the window closing position, and the window glass is opened when the operation position of the operation switch becomes the window opening position.

Further, it is preferred that the drive circuit further includes: a connection line connecting the first relay line to the negative terminal side of the electric power source; a capacitor interposed in the connection line; and a diode, which is mounted onto the first relay line between a location connected to the connection line and a location connected to the first output terminal, and blocks a current flowing from a side connected to the connection line toward a side connected to the first output terminal.

By virtue of this configuration, at the time of closing the window glass, the capacitor interposed in the connection line is charged by a current flowing from the first output terminal via the first relay line to the connection line. Further, when the operation of the operation switch is stopped after both the latching relays are switched through the detection of the pinching, the electricity accumulated in the capacitor are discharged from the first switch contact point to the negative terminal side of the electric power source via the connection line, the first relay line, the first forward rotation excitation coil and the second forward rotation excitation coil, and the fourth relay line. Further, at this time, the diode, which is mounted onto the first relay line between the location connected to the connection line and the location connected to the first output terminal, hinders a discharge current of the capacitor from flowing from the first relay line directly to the first output terminal side without flowing through the fourth relay line.

The first forward rotation excitation coil and the second forward rotation excitation coil are energized by the above-mentioned discharge current of the capacitor. Through the energization of the first forward rotation excitation coil, the first movable piece is operated so that the first forward rotation terminal and the first movable terminal of the first latching relay are connected to each other. Through the energization of the second forward rotation excitation coil, the second movable piece is operated so that the second forward rotation terminal and the second movable terminal of the second latching relay are connected to each other. That is, both the latching relays are switched by the discharge current of the capacitor, and the switching states of both the latching relays are recovered to the original normal state. After the switching states of the latching relays are recovered to the normal state, the window glass is closed when the operation position of the operation switch becomes the window closing position, and the window glass is opened when the operation position of the operation switch becomes the window opening position. As described above, according to the present invention, when the operation of the operation switch is stopped after the start of the reverse operation due to the pinching, the latching relays are automatically recovered by the discharge current of the capacitor after the anti-pinch processing.

Further, it is preferred that the drive circuit further includes a diode, which is mounted onto the fourth relay line, and blocks a current flowing from a side connected to the first output terminal toward a side connected to the another end side of the first forward rotation excitation coil and the another end side of the second forward rotation excitation coil. When the pinching is detected, the diode hinders a current flowing from the fourth relay line toward the second relay line.

Further, it is preferred that the drive circuit further includes a diode, which is mounted onto the third relay line, and blocks a current flowing from a side connected to the second output terminal toward a side connected to the second relay line. The diode prevents a current, which is supplied from the electric power source at the time of the reverse operation due to the pinching, from flowing from the third relay line to the second relay line side.

Further, it is preferred that the drive circuit further includes: a fifth relay line connecting the first relay line and the second output terminal to each other; and a diode, which is mounted onto the fifth relay line, and blocks a current flowing from a side connected to the first relay line toward a side connected to the second output terminal. With this structure, at the time of the opening operation of the window glass, the capacitor is charged by a current flowing via the fifth relay line. Further, the above-mentioned diode hinders the discharge current of the capacitor from flowing from the fifth relay line directly to the second output terminal side without flowing through the fourth relay line.

The respective relay lines represent lines that form the relay circuit for energizing the first and second latching relays. Those relay lines may be connected directly to an energization target (first and second latching relays), or may be connected indirectly thereto via other relay line and electric power supply line. Further, the first relay line may be formed of two lines so that one of the lines is connected to the first connection lead wire and another of the lines is connected to the second connection lead wire. Alternatively, the first relay line may be formed of a single line branched midway so that one of the branched lines is connected to the first connection lead wire and another of the lines is connected to the second connection lead wire. Similarly, the second relay line and the fourth relay line may be formed of two lines, or alternatively, formed of a single line branched midway.

Further, it is preferred that the drive circuit further includes a position detection switch, which is interposed in the third relay line, and is configured to perform a switching operation based on whether or not an open/close position of the window glass is situated within a specific open/close position area that is set in advance. By virtue of this configuration, the object pinching detection switch and the position detection switch are connected in series on the third relay line, and hence both the ends of the third relay line are brought into conduction only when both the switches are held in the conductive state. Thus, the anti-pinch processing is executed only when the pinching is detected under a state in which the open/close position of the window glass is situated within the specific open/close position area.

DESCRIPTION OF EMBODIMENT

Figure 1:
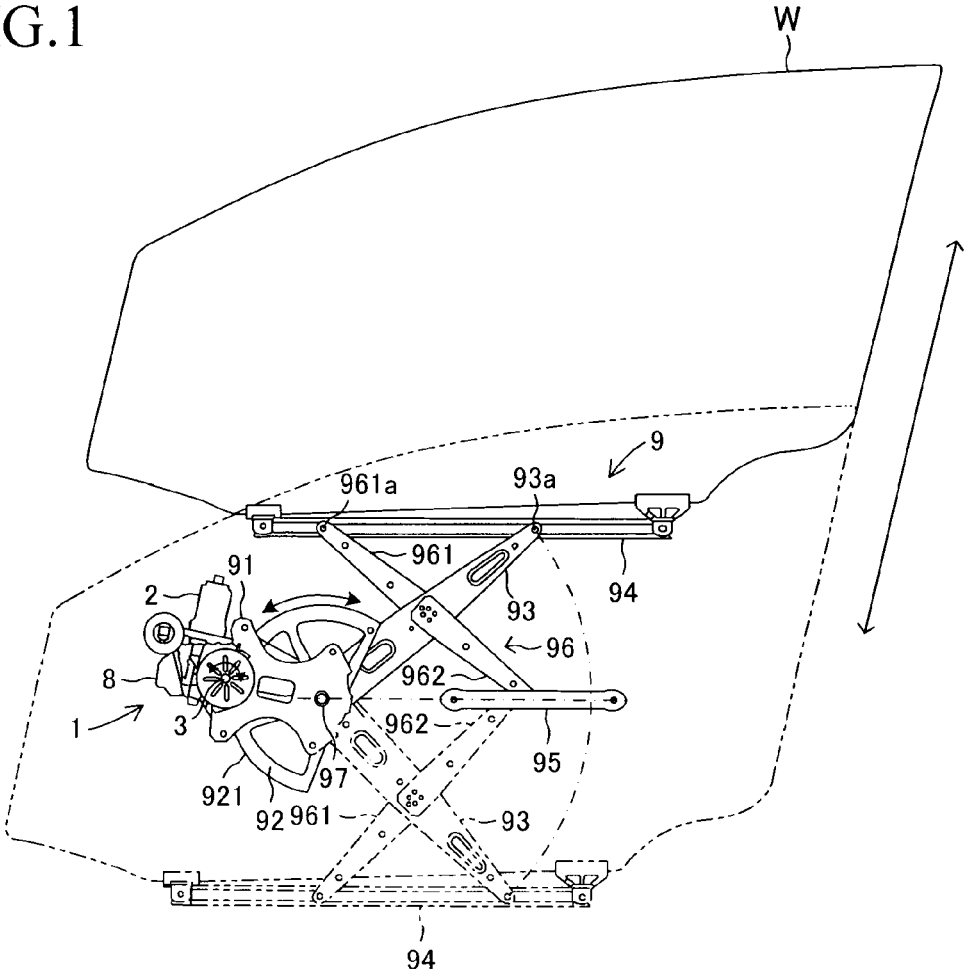
FIG. 1 is a front view illustrating an overall structure of a window regulator device.

Hereinafter, an embodiment of the present invention is described. FIG. 1 is a front view illustrating an overall structure of a window regulator device according to this embodiment. The window regulator device opens and closes a window glass provided to a side window of a vehicle. As illustrated in FIG. 1, the window regulator device includes a drive mechanism 1 and a drive force transmission mechanism 9. The drive mechanism 1 includes an electric motor 2 serving as a power source for generating a force for opening and closing the window glass, an output shaft 3, a housing 8 coupled to the electric motor 2, and a detection unit (not shown) housed in the housing 8. The electric motor 2 is, for example, electrically connected to an electric power source such as an on-vehicle battery, and an electric power is supplied thereto from the electric power source so that a rotational drive force is generated. The output shaft 3 is rotated by the rotational drive force that is generated by the electric motor 2. The drive force transmission mechanism 9 transmits the rotational drive force of the output shaft 3 to a window glass W so as to open and close the window glass W by the rotational drive force of the output shaft 3 in upward and downward directions indicated by the arrows of FIG. 1. The detection unit housed in the housing 8 detects whether or not a foreign object is pinched between the window glass W and a window frame during a closing operation of the window glass W, and whether or not an open/close position of the window glass W is situated within a specific open/close position area that is set in advance.

As illustrated in FIG. 1, the drive force transmission mechanism 9 includes a fixed bracket 91, a sector gear 92, a lift arm 93, a first guide rail member 94, a second guide rail member 95, and an equalizer arm 96. The fixed bracket 91 is fixed to a door panel of the vehicle and supports the housing 8. As illustrated in FIG. 1, the sector gear 92 includes an arc-like tooth portion 921 and is coupled rotatably to the fixed bracket 91 at the center of the arc of the tooth portion 921 so as to be rotatable about a pin 97.

The lift arm 93 is an elongated member and is formed into a tapered shape toward a tip end thereof. The lift arm 93 is fixed to a rotational center position of the sector gear 92 on a base end side thereof. Thus, when the sector gear 92 rotates about the pin 97, the lift arm 93 also rotates in the same direction about the pin 97. Further, a shoe 93*a* is coupled to the tip end of the lift arm 93.

The first guide rail member 94 is fixed substantially horizontally to a lower portion of the window glass W. A guide groove is formed in the first guide rail member 94 along a longitudinal direction thereof. The shoe 93*a* is slidably disposed in the guide groove. The second guide rail member 95 is fixed to the door panel. A guide groove is also formed in the second guide rail member 95 along a longitudinal direction thereof.

The equalizer arm 96 includes a first arm 961 and a second arm 962. Each of the first arm 961 and the second arm 962 is an elongated member. Both the arms are joined at base end sides thereof in the vicinity of a substantial center of the lift arm 93. The first arm 961 and the second arm 962 are linearly fixed so as to have the same axis in front view under the state in which both the arms are joined, and are rotatably coupled to the lift arm 93 in the vicinity of the center of the lift arm 93. Further, a shoe 961*a* is coupled to a tip end of the first arm 961. The shoe 961*a* is slidably disposed in the guide groove of the first guide rail member 94. A shoe is also coupled to a tip end of the second arm 962, and the shoe is slidably disposed in the guide groove of the second guide rail member 95. Thus, the tip end of the lift arm 93 and the tip end of the first arm 961 are coupled to the guide groove of the first guide rail member 94 via the shoes, and the tip end of the second arm 962 is coupled to the guide groove of the second guide rail member 95 via the shoe. Further, dimensions of the arms are adjusted so that the first guide rail member 94 and the second guide rail member 95 are arranged in parallel to each other.

The output shaft 3 is rotatably supported by the housing 8. The output shaft 3 is rotated by the rotational drive force of the electric motor 2. As described later, an output gear portion is formed in the output shaft 3, and the output gear portion meshes with the tooth portion 921 of the sector gear 92.

In this structure, when the output shaft 3 rotates clockwise in FIG. 1, the rotation is transmitted to the sector gear 92, and the sector gear 92 rotates counterclockwise about the pin 97. Along with the rotation of the sector gear 92, the lift arm 93 also rotates counterclockwise about the pin 97. When the lift arm 93 rotates counterclockwise, the shoe 93*a* mounted onto the tip end of the lift arm 93 draws an arc-like locus as indicated by the chain line of FIG. 1. Therefore, the shoe 93*a* slides in the guide groove of the first guide rail member 94 and the first guide rail member 94 moves upward. Along with the upward movement of the first guide rail member 94, the window glass W moves upward so that the window glass W is closed. At the time of the closing operation of the window glass W, the equalizer arm 96 rotates so as to maintain the structural arrangement relationship among the lift arm 93, the first guide rail member 94, and the second guide rail member 95. Thus, at the time of the closing operation of the window glass W, the first guide rail member 94 is raised while maintaining the parallel state with the second guide rail member 95.

Meanwhile, when the output shaft 3 rotates counterclockwise in FIG. 1, the sector gear 92 rotates clockwise about the pin 97. Along with the rotation of the sector gear 92, the lift arm 93 also rotates clockwise about the pin 97. Accordingly, the shoe 93*a* slides in the guide groove of the first guide rail member 94 and the first guide rail member 94 moves downward. Through the downward movement of the first guide rail member 94, the window glass W also moves downward so that the window glass W is operated in an opening direction (opened). At the time of the opening operation of the window glass W, the equalizer arm 96 rotates so as to maintain the structural arrangement relationship among the lift arm 93, the first guide rail member 94, and the second guide rail member 95. Thus, at the time of the opening operation of the window glass W, the first guide rail member 94 is lowered while maintaining the parallel state with the second guide rail member 95. In this manner, the window glass W is opened and closed. Note that, the open/close position of the window glass W indicated by the solid line of FIG. 1 is a fully closed position, and the open/close position of the window glass W indicated by the two-dot chain line of FIG. 1 is a fully opened position.

Figure 2:
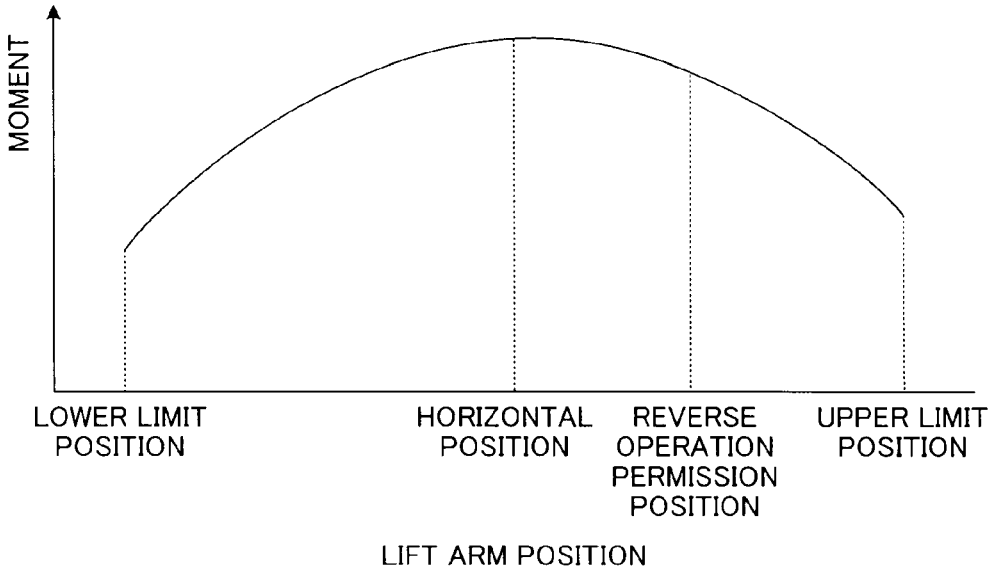
FIG. 2 is a graph showing a relationship between a magnitude of moment, which acts on an output shaft when a window glass is closed from a fully opened position to a fully closed position, and a rotational position of a lift arm.

In the window regulator device including the arm-type drive force transmission mechanism 9 that is operated as described above, rotational motion of the lift arm 93 is converted into linear motion of the window glass W. Thus, at the time of the closing operation of the window glass W, the moment acting on the output shaft 3 due to the load of the window glass W changes depending on a rotational position of the lift arm 93. FIG. 2 is a graph showing a relationship between the magnitude of the moment, which acts on the output shaft 3 when the window glass W is closed from the fully opened position (lower limit position) to the fully closed position (upper limit position), and the rotational position of the lift arm 93. As can be seen from the graph, the moment exhibits the maximum value when the rotational position of the lift arm 93 is a horizontal position orthogonal to the direction of gravity. The moment becomes smaller as the rotational position of the lift arm 93 shifts from the horizontal position toward the upper limit position (fully closed position of the window glass W) or the lower limit position (fully opened position of the window glass).

Figure 3:
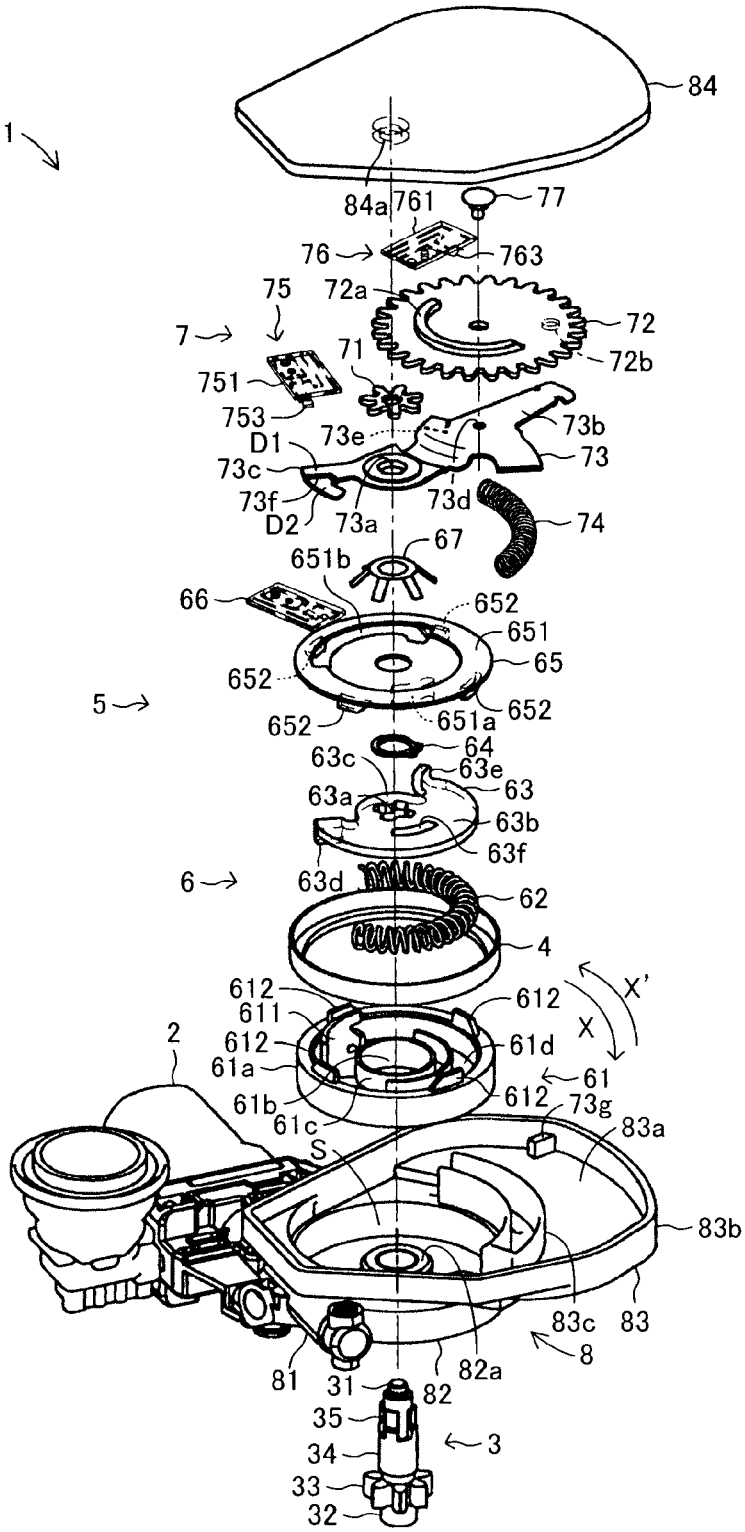
FIG. 3 is an exploded perspective view of a drive mechanism.

FIG. 3 is an exploded perspective view of the drive mechanism 1. As illustrated in FIG. 3, the drive mechanism 1 includes the electric motor 2, the output shaft 3, a detection unit 5, and the housing 8. The electric motor 2 is coupled to the housing 8 by fastening means (not shown) or the like. The housing 8 includes a first housing portion 81, a second housing portion 82, a third housing portion 83, and a lid 84. The first housing portion 81 is formed into a cylindrical shape elongated in an axial direction of the electric motor 2, and a worm (not shown) coupled to a motor shaft of the electric motor 2 is housed in the first housing portion 81. The worm rotates coaxially with the motor shaft. The second housing portion 82 is arranged adjacent to a peripheral side portion of the first housing portion 81, and is formed into a cylindrical shape having an axis orthogonal to a cylindrical axis of the first housing portion 81. Further, the second housing portion 82 has an opening on an upper end side thereof. Note that, an internal space of the first housing portion 81 and an internal space of the second housing portion 82 communicate to each other at adjacent locations of both the housing portions.

The third housing portion 83 is arranged and formed at an upper portion of the second housing portion 82. The third housing portion 83 has a bottom surface 83*a* extending substantially horizontally to the right of FIG. 3 from an edge of the upper end opening of the second housing portion 82, and a side wall 83*b* held upright from a peripheral edge of the bottom surface 83*a*. Thus, as can be seen from FIG. 3, a circular space S recessed from the bottom surface 83*a* of the third housing portion 83 corresponds to the space of the second housing portion 82. The third housing portion 83 has an opening at an upper end thereof, and the opening is closed by the lid 84. The lid 84 is fixed to the third housing portion 83 by fastening means (not shown). In the third housing portion 83, a retention spring housing partition wall 83*c* for housing a retention spring 74 described later is formed into an arc shape along the space S.

As illustrated in FIG. 3, a cylindrical boss 82*a* is formed at a center part of a bottom surface of the second housing portion 82. The output shaft 3 is inserted through a circular hole formed in the boss 82*a*. The output shaft 3 enters the internal spaces of the second housing portion 82 and the third housing portion 83. The output shaft 3 has a tip end portion 31 and a base end portion 32. An output gear portion 33, a shaft portion 34, and an engagement portion 35 are formed in the stated order in a region from the base end portion 32 to the tip end portion 31. As described above, the output gear portion 33 meshes with the sector gear 92 of the drive force transmission mechanism 9, and the rotational drive force of the output shaft 3 is transmitted to the drive force transmission mechanism 9. The engagement portion 35 is formed into a substantially cross shape in cross-section and is fitted into a driven plate 63 described later. The shaft portion 34, the engagement portion 35, and the tip end portion 31 enter the internal spaces of the second housing portion 82 and the third housing portion 83. The tip end portion 31 is inserted into a recessed portion 84*a*, which is formed in an inner surface of the lid 84 (surface facing the internal space of the housing 8). Accordingly, the output shaft 3 is supported by the housing 8 so as to be rotatable and axially immovable.

The detection unit 5 is housed in the housing 8. The detection unit 5 includes an object pinching detection unit 6 and a position detection unit 7. The object pinching detection unit 6 is disposed in the second housing portion 82. The object pinching detection unit 6 includes a worm wheel 61, a drive force transmission spring 62, the driven plate 63, a washer 64, an object pinching detection plate 65, an object pinching detection switch 66, and a flat spring 67.

The worm wheel 61 is arranged at a lowermost portion of the internal space S of the second housing portion 82 in FIG. 3. The worm wheel 61 is formed into a cylindrical shape. Further, the worm wheel 61 has an outer peripheral wall portion 61*a* having teeth (for example, helical teeth) formed on an outer peripheral side thereof, a cylindrical inner peripheral wall portion 61*c* having a circular hole 61*b* formed in an inner periphery thereof, and a ring-like bottom surface portion 61*d* connecting together a lower end of the outer peripheral wall portion 61*a* and a lower end of the inner peripheral wall portion 61*c*. The boss 82*a* of the second housing portion 82 is fitted into the circular hole 61*b*, and hence the worm wheel 61 is rotatably supported by the second housing portion 82. The output shaft 3 is inserted through the circular hole 61*b*. Further, the teeth formed in the outer peripheral wall portion 61*a* mesh with the worm housed in the first housing portion 81. The worm wheel 61 and the worm constitute a worm reduction gear. Thus, when the worm rotates, the rotation is transmitted to the worm wheel 61, and the worm wheel 61 performs reduced rotation around the output shaft 3. The worm wheel 61 corresponds to an input-side rotational member of the present invention.

A locking portion 611 is formed in the worm wheel 61. The locking portion 611 is held upright from the bottom surface portion 61*d*, and has a height larger than the height of the outer peripheral wall portion 61*a*. Further, a plurality of (in this embodiment, four) protruding pieces 612 formed into a projecting shape along a circumferential direction of the outer peripheral wall portion 61*a* are provided at regular intervals on an upper end surface of the outer peripheral wall portion 61*a*. Each of the protruding pieces 612 is formed into an arc shape along the outer peripheral wall portion 61*a*, and all the protruding pieces 612 have the same shape. The protruding piece 612 corresponds to an input-side projection/recess portion of the present invention.

The drive force transmission spring 62 is disposed on the bottom surface portion 61*d* of the worm wheel 61. The drive force transmission spring 62 is formed into an arc shape along the bottom surface portion 61*d*, and is locked at one end thereof by the locking portion 611. The drive force transmission spring 62 corresponds to an elastic member of the present invention.

The driven plate 63 is formed into a substantially disk shape, in which a part of the driven plate 63 in a circumferential direction thereof is cut out into a fan shape. The driven plate 63 has a large-diameter portion 63*b* having a large diameter and a small-diameter portion 63*c* having a small diameter, which are arranged with the part cut out into the fan shape as a border therebetween. A cross-like through-hole 63*a* is formed at a center portion of the driven plate 63. The engagement portion 35 of the output shaft 3 is fitted into the cross-like through-hole 63*a*. Accordingly, the driven plate 63 is coupled to the output shaft 3 so as to be rotatable integrally with the output shaft 3. Further, the driven plate 63 has its axial movement regulated by the washer 64 arranged at an upper portion of the driven plate 63. In the second housing portion 82, the driven plate 63 having such a shape is coaxially disposed above the worm wheel 61. At this time, the locking portion 611 formed in the worm wheel 61 protrudes through a gap formed by the part of the driven plate 63 cut out into the fan shape, and accordingly interference between the locking portion 611 and the driven plate 63 is prevented. Further, a first protruding piece 63*d* is formed in the driven plate 63 so as to extend, in FIG. 3, downward from one of circumferential end portions (cutout end portions) of the large-diameter portion 63*b*, and a second protruding piece 63*e* is formed in the driven plate 63 so as to extend, in FIG. 3, upward from another of the circumferential end portions of the large-diameter portion 63*b*. Another end of the drive force transmission spring 62 disposed in the worm wheel 61 is engaged with the first protruding piece 63*d*. Thus, the drive force transmission spring 62 engages with the locking portion 611 of the worm wheel 61 at the one end and engages with the first protruding piece 63*d* of the driven plate 63 at the another end. Further, as illustrated in FIG. 3, an arc-like long hole 63*f* extending along the circumferential direction is formed in the large-diameter portion 63*b* of the driven plate 63.

The object pinching detection plate 65 includes a rotary plate 651 formed into a stepped disk shape, and a plurality of protruding pieces 652 provided at regular intervals and formed into a projecting shape along a circumferential direction of the rotary plate 651 in the vicinity of an outer peripheral edge of a lower surface of the rotary plate 651 in FIG. 3. A circular hole for inserting the output shaft 3 therethrough is formed at the center of the rotary plate 651. Further, a projecting portion 651*a* having an arc shape in cross-section is formed on the lower surface side of the rotary plate 651. The projecting portion 651*a* has a cross-section that is formed into the same shape as the long hole 63*f* formed in the driven plate 63. The object pinching detection plate 65 is coaxially placed on the driven plate 63 so that the projecting portion 651*a* is fitted into the long hole 63*f*. Accordingly, the object pinching detection plate 65 is coupled to the driven plate 63 so as to be integrally rotatable and axially movable, and both the plates 63 and 65 integrally rotate about the output shaft 3 as a center shaft. An assembly of the driven plate 63 and the object pinching detection plate 65 corresponds to an output-side rotational member of the present invention.

Further, an arc-like long hole 651*b* is formed in the rotary plate 651 along the circumferential direction thereof. When the object pinching detection unit 6 is housed in the second housing portion 82, the second protruding piece 63*e* formed in the driven plate 63 and the locking portion 611 formed in the worm wheel 61 protrude through the long hole 651*b*.

The plurality of protruding pieces 652 are provided along the circumferential direction of the rotary plate 651. Distances in a radial direction from the center of the rotary plate 651 to the protruding pieces 652 are equal to one another. Each of the protruding pieces 652 is formed into an arc shape along the circumferential direction of the rotary plate 651, and all the protruding pieces 652 have the same shape. The number of the protruding pieces 652 is equal (in this embodiment, four) to the number of the protruding pieces 612 formed on the outer peripheral wall portion 61*a* of the worm wheel 61. The distance in the radial direction from the center of the rotary plate 651 to each of the protruding pieces 652 is equal to a distance in the radial direction from the center of the worm wheel 61 to each of the protruding pieces 612 formed on the outer peripheral wall portion 61*a*. Thus, when the assembly of the object pinching detection plate 65 and the driven plate 63 (output-side rotational member) is arranged above the worm wheel 61 (input-side rotational member), the protruding pieces 652 face the upper end surface of the outer peripheral wall portion 61*a* of the worm wheel 61. When the worm wheel 61 and the object pinching detection plate 65 rotate about the output shaft 3, the protruding pieces 652 and the protruding pieces 612 rotate concyclically. The protruding pieces 652 correspond to an output-side projection/recess portion of the present invention.

Figure 10:
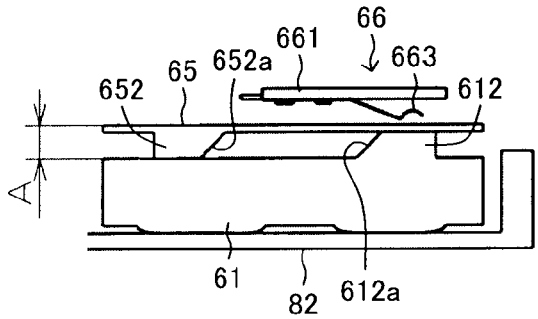
FIG. 10 is a schematic side view illustrating an operation state of a worm wheel and an object pinching detection plate in a case where a foreign object is not pinched.

FIG. 10 is a side view illustrating an arrangement relationship between the worm wheel 61 and the object pinching detection plate 65. As illustrated in FIG. 10, the object pinching detection plate 65 is arranged coaxially with the worm wheel 61 so as to face the worm wheel 61. The protruding pieces 612 are formed on the surface of the worm wheel 61 facing the object pinching detection plate 65 (specifically, the upper end surface of the outer peripheral wall portion 61*a* of the worm wheel 61), and the protruding pieces 652 are formed on the surface of the object pinching detection plate 65 facing the worm wheel 61 (lower surface of FIG. 10). The protruding pieces 612 and 652 correspond to cam means of the present invention.

A tapered surface 612*a* is formed in each protruding piece 612. When the worm wheel 61 rotates in an X direction in FIG. 3, the tapered surface 612*a* is formed on a head side of the rotational direction of the protruding piece 612. The tapered surface 612*a* is inclined relative to the X direction so that a bottom surface side of the protruding piece 612 is longer than a leading end side thereof. Due to the presence of the tapered surface 612*a*, the protruding piece 612 has a substantially trapezoidal shape in side view.

Further, a tapered surface 652*a* is formed in each protruding piece 652. The tapered surface 652*a* is formed on a side where the protruding piece 612 approaches when the worm wheel 61 rotates in the X direction relative to the object pinching detection plate 65. That is, the tapered surface 652*a* is a surface facing the tapered surface 612*a* of the protruding piece 612. The tapered surface 652*a* is inclined relative to the X direction so that a bottom surface side of the protruding piece 652 is longer than a leading end side thereof. Due to the presence of the tapered surface 652*a*, the protruding piece 652 has a substantially inverted trapezoidal shape in side view.

Further, as can be seen from FIG. 10, when the worm wheel 61 and the object pinching detection plate 65 rotate relative to each other, the protruding pieces 612 and the protruding pieces 652 interfere with each other. In a case where both the protruding pieces 612 and 652 interfere with each other when the worm wheel 61 rotates in the arrow X direction in FIG. 3 and the object pinching detection plate 65 does not rotate, the tapered surface 612*a* of each protruding piece 612 and the tapered surface 652*a* of each protruding piece 652 engage with each other. At the time of engagement, both the tapered surfaces 612*a* and 652*a* are brought into surface contact with each other. The tapered surfaces 612*a* and 652*a* each correspond to an engagement surface of the present invention.

As illustrated in FIG. 3, the flat spring 67 has a ring-like part, and plate-like parts radially extending from the ring-like part, and the output shaft 3 is inserted through the ring-like part. The flat spring 67 is interposed between the object pinching detection plate 65 and an operation lever 73 described later. Thus, an elastic force of the flat spring 67 acts on the object pinching detection plate 65. By the elastic force, the object pinching detection plate 65 is pressed against the driven plate 63 via the washer 64.

Figure 4:
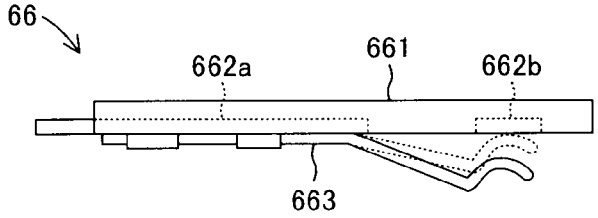
FIG. 4 is a schematic side view of an object pinching detection switch.

FIG. 4 is a schematic side view of the object pinching detection switch 66. As can be seen from FIG. 4, the object pinching detection switch 66 includes a substrate 661, a first conductive portion 662*a* and a second conductive portion 662*b* formed on the substrate 661, and a movable piece 663 connected at one end thereof to the first conductive portion 662*a*. When a leading end of the movable piece 663 is spaced apart from the substrate 661 as indicated by the solid line, the first conductive portion 662*a* and the second conductive portion 662*b* are held in a non-conductive state. On the other hand, when the leading end of the movable piece 663 is pressed and is brought into contact with the second conductive portion 662*b* on the substrate 661 as indicated by the broken line, the first conductive portion 662*a* and the second conductive portion 662*b* are brought into a conductive state via the movable piece 663. When the first conductive portion 662*a* and the second conductive portion 662*b* are held in the non-conductive state, a switching state of the object pinching detection switch 66 is an OFF state, and when the first conductive portion 662*a* and the second conductive portion 662*b* are held in the conductive state, the switching state of the object pinching detection switch 66 is an ON state. The movable piece 663 corresponds to a movable contact point of the present invention, and the second conductive portion 662*b* corresponds to a fixed contact point of the present invention.

The object pinching detection switch 66 is arranged immediately above the object pinching detection plate 65 in FIG. 3 so that the movable piece 663 thereof faces the object pinching detection plate 65, and a position of the object pinching detection switch 66 is fixed by fixing means (not shown). Thus, the switching state of the object pinching detection switch 66 changes through axial movement of the object pinching detection plate 65. The object pinching detection switch 66 may be formed on the inner surface side of the lid 84.

Note that, a lubricant such as grease is generally applied to a meshing surface between the worm and the worm wheel 61. In order to prevent the grease from flying, a flying prevention plate 4 is provided. The flying prevention plate 4 is placed at a position on the bottom surface 83*a* of the third housing portion 83, at which the flying prevention plate 4 surrounds the space S in the second housing portion 82.

Figure 5:
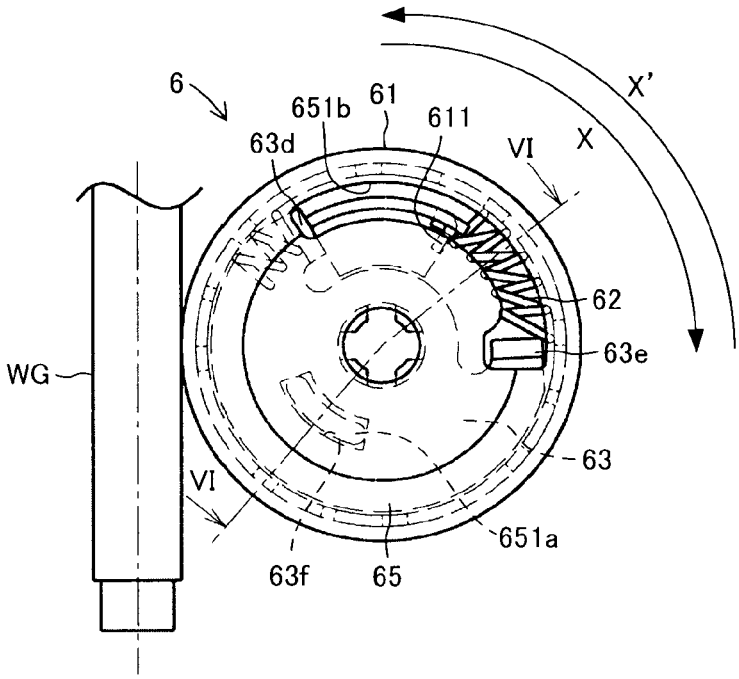
FIG. 5 is a front view of an object pinching detection unit.
Figure 6:
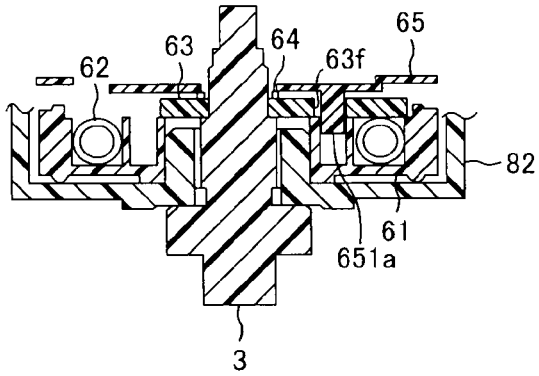
FIG. 6 is a sectional view taken along the line VI-VI of FIG. 5.

FIG. 5 is a front view of the object pinching detection unit 6 obtained by assembling the respective components. FIG. 6 is a sectional view taken along the line VI-VI of FIG. 5. As can be seen from FIG. 5, the worm wheel 61 meshes with a worm WG housed in the first housing portion 81. When the worm wheel 61 rotates in the X direction of FIG. 5 (the X direction is the same as the X direction of FIG. 3), the drive force transmission spring 62, which is locked at one end thereof by the locking portion 611 formed in the worm wheel 61, is pressed in the X direction, and the driven plate 63, which locks another end of the drive force transmission spring 62 by the first protruding piece 63*d*, is pressed in the X direction by the drive force transmission spring 62.

The position detection unit 7 is disposed in the third housing portion 83. As illustrated in FIG. 3, the position detection unit 7 includes a first gear 71, a second gear 72, the operation lever 73, the retention spring 74, an insensitive area detection switch 75, a reverse operation area detection switch 76, a coupling pin 77, and a stopper 73*g* mounted onto the third housing portion 83. A circular hole is formed at the center of the first gear 71. The output shaft 3 is fitted into the circular hole, and accordingly the first gear 71 is supported by the output shaft 3 so as to be rotatable integrally therewith. The second gear 72 is arranged at a position at which the second gear 72 meshes with the first gear 71. As can be seen from FIG. 3, the number of teeth of the second gear 72 is larger than the number of teeth of the first gear 71. Thus, the second gear 72 reduces the rotation of the first gear 71. Further, a cam 72*a* having a projecting shape is formed on an upper surface of the second gear 72 in FIG. 3. The cam 72*a* has a predetermined length along a circumferential direction of the second gear 72, and is formed into an arc shape along the circumferential direction. Further, a columnar projecting portion 72*b* is formed on a lower surface of the second gear 72 in FIG. 3. Further, a circular hole is formed at the center of the second gear 72, and the coupling pin 77 is inserted through the circular hole. The second gear 72 is rotatably supported by the coupling pin 77.

Figure 7:
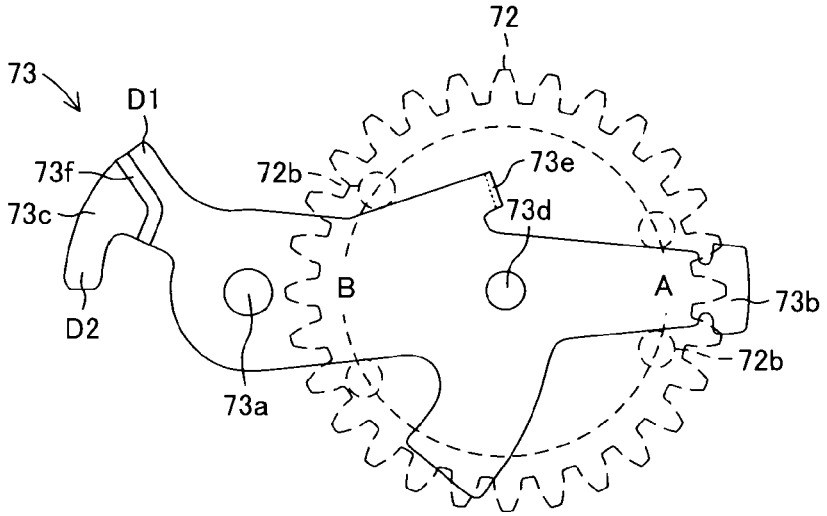
FIG. 7 is a front view of an operation lever.

The operation lever 73 is disposed below the first gear 71 and the second gear 72 in FIG. 3, and is formed into an elongated flat plate shape. FIG. 7 is a front view of the operation lever 73. As can be seen from FIG. 7, a first circular hole 73*a* for inserting the output shaft 3 therethrough is formed in the operation lever 73. The output shaft 3 is inserted through the first circular hole 73*a*, and accordingly the operation lever 73 is supported by the output shaft 3 so as to be rotatable relative to the output shaft 3. Note that, after the output shaft 3 is inserted through the first circular hole 73*a*, the output shaft 3 is inserted through the circular hole formed in the first gear 71.

Further, the operation lever 73 has a first arm portion 73*b* extending toward one side (right side of FIG. 7) in a longitudinal direction thereof from the first circular hole 73*a*, and a second arm portion 73*c* extending toward the other side (left side of FIG. 7). A second circular hole 73*d* is formed substantially at the center of the first arm portion 73*b*. Through the second circular hole 73*d*, the coupling pin 77, which is inserted through the second gear 72, is inserted. The operation lever 73 is coupled to the second gear 72 via the coupling pin 77. Thus, the operation lever 73 is supported by the output shaft 3, which rotates integrally with the first gear 71, so as to be rotatable relative to the output shaft 3, and is coupled to the second gear 72 via the coupling pin 77. As illustrated in FIG. 7, the second gear 72 is rotatably arranged at a position immediately above the first arm portion 73*b* of the operation lever 73. The first arm portion 73*b* is formed into a rugged shape so that, when the second gear 72 rotates, the projecting portion 72*b* formed on the lower surface of the second gear 72 engages with a leading end part A of the first arm portion 73*b* and does not engage with a base end part B thereof. Further, a locking portion 73*e* is formed in the first arm portion 73*b*. The locking portion 73*e* locks one end of the retention spring 74 described later. Further, a step 73*f* is formed at a leading end portion of the second arm portion 73*c*. When an axial direction of the first circular hole 73*a* is defined as a height direction, the height of one part D1 and the height of another part D2, which sandwich the step 73*f*, are different from each other.

The retention spring 74 is housed in the retention spring housing partition wall 83*c* that is formed in the third housing portion 83. As illustrated in FIG. 3, the retention spring housing partition wall 83*c* is formed of two arc-like walls that are formed concentrically, and a bottom wall closing one end side of the arc-like walls, and the retention spring housing partition wall 83*c* has an opening on another end side thereof. The retention spring 74 housed in such a retention spring housing partition wall 83*c* is locked at one end thereof by the locking portion 73*e* of the operation lever 73 as described above, and is locked at another end thereof by the bottom wall of the retention spring housing partition wall 83*c*. Thus, the operation lever 73 is biased by a stretching force that is generated by the retention spring 74 so as to rotate about the first circular hole 73*a*, but this rotation is regulated when the leading end part of the first arm portion 73*b* of the operation lever 73 engages with the stopper 73*g* provided in the third housing portion 83. Through the regulation, the operation lever 73 is aligned.

Figure 8:
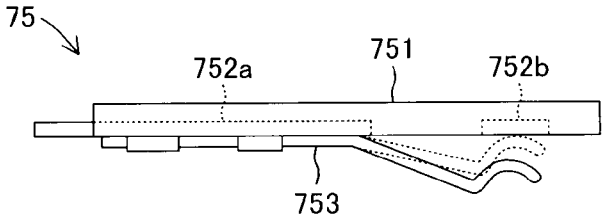
FIG. 8 is a schematic side view of an insensitive area detection switch.
Figure 9:
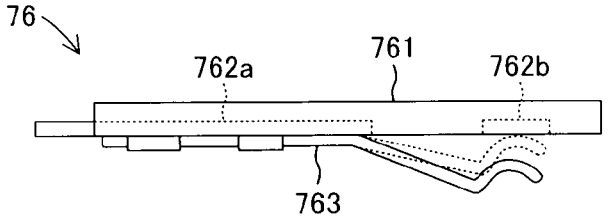
FIG. 9 is a schematic side view of a reverse operation area detection switch.

FIG. 8 is a schematic side view of the insensitive area detection switch 75. FIG. 9 is a schematic side view of the reverse operation area detection switch 76. Similarly to the object pinching detection switch 66, the switches 75 and 76 respectively include substrates 751 and 761, first conductive portions 752*a* and 762*a* and second conductive portions 752*b* and 762*b* respectively formed on the substrates 751 and 761, and movable pieces 753 and 763 respectively connected at one end thereof to the first conductive portions 752*a* and 762*a*. When leading ends of the movable pieces 753 and 763 are respectively spaced apart from the substrates 751 and 761 as indicated by the solid lines, the first conductive portions 752*a* and 762*a* and the second conductive portions 752*b* and 762*b* are held in a non-conductive state, respectively. On the other hand, when the leading ends of the movable pieces 753 and 763 are respectively pressed and brought into contact with the second conductive portions 752*b* and 762*b* on the substrates 751 and 761 as indicated by the broken lines, the first conductive portions 752*a* and 762*a* and the second conductive portions 752*b* and 762*b* are brought into a conductive state via the movable pieces 753 and 763, respectively. When the first conductive portions 752*a* and 762*a* and the second conductive portions 752*b* and 762*b* are respectively held in the non-conductive state, the switching state of the switches 75 and 76 is an OFF state, and when the first conductive portions 752*a* and 762*a* and the second conductive portions 752*b* and 762*b* are respectively held in the conductive state, the switching state of the switches 75 and 76 is an ON state.

As can be seen from FIG. 3, the insensitive area detection switch 75 is disposed immediately above the operation lever 73. Specifically, the insensitive area detection switch 75 is fixed at such a position that, when the operation lever 73 rotates about the first circular hole 73*a*, the leading end portion of the movable piece 753 climbs over the step 73*f* formed at the leading end of the second arm portion 73*c* of the operation lever 73. When the operation lever 73 is viewed from the insensitive area detection switch 75 fixed at such a position, of the one part D1 and the another part D2 sandwiching the step 73*f* of the second arm portion 73*c* of the operation lever 73, the one part D1 is closer to the insensitive area detection switch 75 as compared to the another part D2. That is, in FIG. 3, the height position of the part D1 is higher than the height position of the part D2. When the leading end part of the movable piece 753 is held in contact with the part D1, the movable piece 753 is pressed and the leading end portion thereof is brought into contact with the second conductive portion 752*b* on the substrate 751, with the result that the switching state of the insensitive area detection switch 75 becomes the ON state. On the other hand, when the leading end portion of the movable piece 753 is held in contact with the part D2, the leading end portion of the movable piece 753 is spaced apart from the second conductive portion 752*b* on the substrate 751, with the result that the switching state of the insensitive area detection switch 75 becomes the OFF state.

The reverse operation area detection switch 76 is disposed immediately above the second gear 72. Specifically, the reverse operation area detection switch 76 is fixed at such a position that, when the second gear 72 rotates, the leading end portion of the movable piece 763 may be brought into contact with the cam 72*a* formed on the second gear 72 over a length direction thereof. When the leading end portion of the movable piece 763 is held in contact with the cam 72*a*, the leading end portion of the movable piece 763 is pressed by the cam 72*a* and is brought into contact with the second conductive portion 762*b* on the substrate 761, with the result that the switching state of the reverse operation area detection switch 76 becomes the ON state. On the other hand, when the leading end of the movable piece 763 is not held in contact with the cam 72*a*, the leading end portion of the movable piece 763 is spaced apart from the second conductive portion 762*b* on the substrate 761, with the result that the switching state of the reverse operation area detection switch 76 becomes the OFF state. Note that, the insensitive area detection switch 75 and the reverse operation area detection switch 76 may be formed directly on the lid 84.

In the window regulator device structured as described above, when the rotation of the electric motor 2 is transmitted to the worm wheel 61 and the worm wheel 61 rotates in the arrow X direction of FIGS. 3 and 5, the drive force transmission spring 62, which is locked at one end thereof by the locking portion 611 formed in the worm wheel 61, is pressed and the drive force transmission spring 62 also rotates in the X direction. When the drive force transmission spring 62 rotates in the X direction, the driven plate 63, which locks another end of the drive force transmission spring 62 by the first protruding piece 63*d*, also rotates in the X direction. Along with the rotation of the driven plate 63, the object pinching detection plate 65 and the output shaft 3 rotate in the X direction. The X-directional rotation of the output shaft 3 corresponds to the clockwise rotation of the output shaft 3 in FIG. 1. Thus, through the rotation of the output shaft 3, the lift arm 93 of the drive force transmission mechanism 9 rotates counterclockwise in FIG. 1. Accordingly, the window glass W is closed.

On the other hand, when the worm wheel 61 rotates in an arrow X' direction of FIGS. 3 and 5, the locking portion 611 moves in a direction in which the locking portion 611 is spaced apart from the drive force transmission spring 62, and then engages with the first protruding piece 63*d* of the driven plate 63. Through the engagement, the rotational drive force of the worm wheel 61 is transmitted directly to the driven plate 63 without intermediation of the drive force transmission spring 62. Therefore, the driven plate 63 rotates in the X' direction, and along with the rotation, the object pinching detection plate 65 and the output shaft 3 rotate in the X' direction. The X'-directional rotation of the output shaft 3 corresponds to the counterclockwise rotation of the output shaft 3 in FIG. 1. Thus, through the rotation of the output shaft 3, the lift arm 93 of the drive force transmission mechanism 9 rotates clockwise in FIG. 1. Accordingly, the window glass W is opened.

Next, a switching operation of the object pinching detection switch 66 is described. When the foreign object is not pinched between the window glass W and the window frame at the time of the closing operation of the window glass W, the rotational drive force of the electric motor 2 is transmitted to the output shaft 3 with no change. At this time, the worm wheel 61 and the object pinching detection plate 65 integrally rotate in synchronization. FIG. 10 is a schematic side view illustrating an operation state of the worm wheel 61 and the object pinching detection plate 65 in this case. When the worm wheel 61 and the object pinching detection plate 65 rotate in synchronization, as illustrated in FIG. 10, the distance between the protruding piece 612 formed on the worm wheel 61 and the protruding piece 652 formed on the object pinching detection plate 65 does not change. Therefore, both the protruding pieces 612 and 652 do not interfere with each other and rotate concyclically under a state in which a constant interval is maintained therebetween. Further, the leading end portion of the movable piece 663 of the object pinching detection switch 66, which is placed at an upper portion of the object pinching detection plate 65, is not held in contact with the object pinching detection plate 65, and therefore the leading end portion of the movable piece 663 is not brought into contact with the second conductive portion 662*b* formed on the substrate 661. That is, when the foreign object is not pinched, the switching state of the object pinching detection switch 66 is the OFF state.

Figure 11:
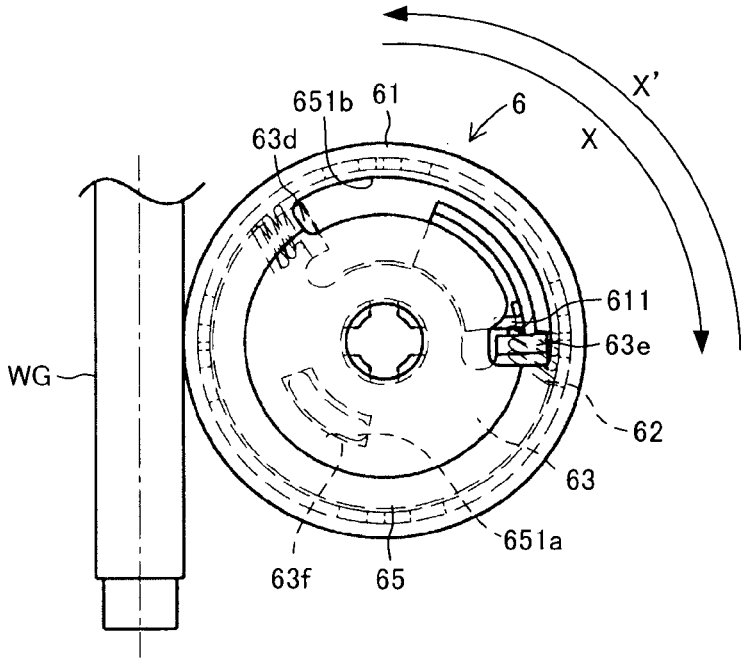
FIG. 11 is a front view of the object pinching detection unit, illustrating an operation state at the time when a drive force transmission spring is compressed.

On the other hand, when the foreign object is pinched between the window glass W and the window frame at the time of the closing operation of the window glass W, the closing operation (raising) of the window glass W is interrupted due to the presence of the foreign object. Therefore, the rotation of the output shaft 3 is stopped. Along with the stop of rotation of the output shaft 3, the rotation of the driven plate 63 and the object pinching detection plate 65 is also stopped. However, the worm wheel 61 continues to rotate in the X direction of FIGS. 3 and 5 in response to the rotational drive force of the electric motor 2. Therefore, the worm wheel 61 rotates in the X direction relative to the driven plate 63 and the object pinching detection plate 65. At this time, the first protruding piece 63*d* formed in the driven plate 63 is stopped, whereas the locking portion 611 formed in the worm wheel 61 rotates. Therefore, the drive force transmission spring 62 sandwiched between the first protruding piece 63*d* and the locking portion 611 is compressed through the X-directional rotation of the locking portion 611. That is, the drive force transmission spring 62 is compressed, and accordingly the X-directional rotation of the worm wheel 61 relative to the driven plate 63 and the object pinching detection plate 65 is allowed. FIG. 11 is a front view of the object pinching detection unit 6, illustrating an operation state at the time when the drive force transmission spring 62 is compressed. Note that, when the locking portion 611 rotates in the X direction relative to the driven plate 63, the locking portion 611 is then locked by the second protruding piece 63*e* formed in the driven plate 63. Accordingly, further relative rotation of the worm wheel 61 is regulated.

Figure 12:
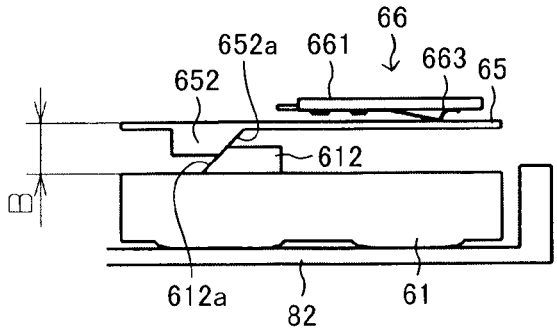
FIG. 12 is a schematic side view illustrating a state in which protruding pieces formed on the worm wheel and the object pinching detection plate interfere with each other.

When the worm wheel 61 rotates in the X direction relative to the object pinching detection plate 65, the distance between the protruding piece 612 formed on the worm wheel 61 and the protruding piece 652 formed on the object pinching detection plate 65 is reduced, and then both the protruding pieces interfere with each other. FIG. 12 is a side view illustrating a state in which both the protruding pieces 612 and 652 interfere with each other. As illustrated in FIG. 12, both the protruding pieces 612 and 652 engage with each other at the respective tapered surfaces 612*a* and 652*a*. Through the engagement, the protruding piece 652 of the object pinching detection plate 65 moves so as to slide along the tapered surface 612*a*, and overrides the protruding piece 612 of the worm wheel 61. Accordingly, the object pinching detection plate 65 is pushed upward. In this case, a plurality of (four) protruding pieces 612 and a plurality of (four) protruding pieces 652 are provided, and the respective protruding pieces are arranged at regular intervals. Therefore, the plurality of protruding pieces 652 simultaneously override the plurality of protruding pieces 612. Thus, the object pinching detection plate 65 axially moves in a direction in which the object pinching detection plate 65 is spaced apart from the worm wheel 61, while maintaining the horizontal state without being inclined in the circumferential direction.

When the object pinching detection plate 65 is pushed upward through the engagement between the protruding pieces 612 and 652, as illustrated in FIG. 12, an upper surface of the object pinching detection plate 65 presses the movable piece 663 of the object pinching detection switch 66. Accordingly, the leading end portion of the movable piece 663 is brought into contact with the second conductive portion 662*b* formed on the substrate 661, with the result that the first conductive portion 662*a* and the second conductive portion 662*b* are brought into the conductive state via the movable piece 663. That is, when the foreign object is pinched, the switching state of the object pinching detection switch 66 becomes the ON state.

As can be seen from the above description, when the object pinching detection plate 65 does not axially move (is not pushed up), that is, when the pinching does not occur, the switching state of the object pinching detection switch 66 becomes the OFF state, and when the object pinching detection plate 65 axially moves (is pushed up) in the direction in which the object pinching detection plate 65 is spaced apart from the worm wheel 61, that is, when the pinching has occurred, the switching state of the object pinching detection switch 66 becomes the ON state. In other words, when the distance between the object pinching detection plate 65 and the worm wheel 61 at the time when the object pinching detection plate 65 is not pushed up is defined as "A" (see FIG. 10), and the distance between the object pinching detection plate 65 and the worm wheel 61 at the time when the object pinching detection plate 65 is pushed up is defined as "B" (see FIG. 12), the object pinching detection switch 66 is arranged at such a position that the switching state thereof becomes the OFF state when the distance corresponds to "A" and becomes the ON state when the distance corresponds to "B".

Further, at the time of pinching of the foreign object, the rotation of the object pinching detection plate 65 is stopped in association with the stop of rotation of the output shaft 3. Therefore, the object pinching detection plate 65 axially moves without rotation, and is brought into contact with the movable piece 663 of the object pinching detection switch 66 without rotation. Therefore, wear due to rotation does not occur when the object pinching detection plate 65 and the movable piece 663 are brought into contact with each other. Thus, deterioration in object pinching detection accuracy due to the wear is prevented.

Figure 13:
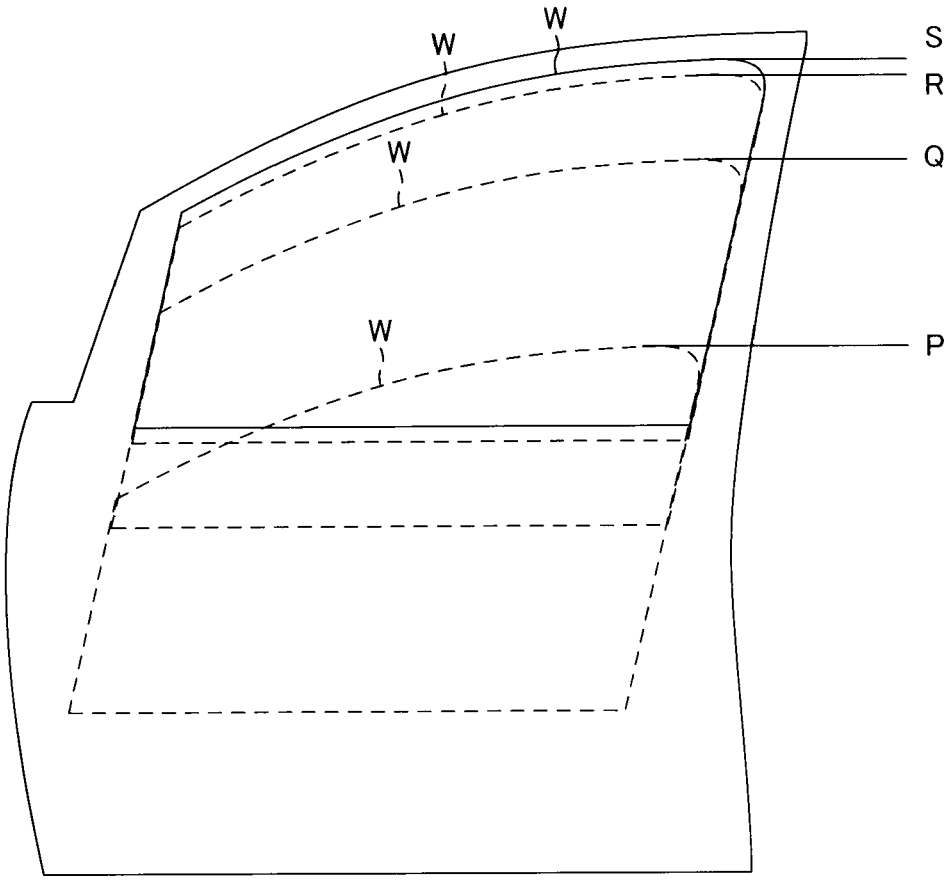
FIG. 13 is a schematic view illustrating open/close positions of the window glass.

Next, an operation of the position detection unit 7 is described. As can be seen from FIG. 3, the first gear 71 of the position detection unit 7 is coupled to the output shaft 3, and hence integrally rotates along with the rotation of the output shaft 3. When the first gear 71 rotates, the second gear 72 meshing with the first gear 71 rotates in a direction opposite to the direction of the first gear 71. Through the rotation of the second gear 72, the projecting portion 72*b* formed on the lower surface of the second gear 72 also rotates. The rotational position of the projecting portion 72*b* relative to the operation lever 73 is determined in advance in association with the open/close position of the window glass W, which changes along with the rotation of the output shaft 3. FIG. 13 is a schematic view illustrating the open/close positions of the window glass W.

In FIG. 13, each open/close position of the window glass W is represented by an upper end position of the window glass W. When the open/close position of the window glass W is the fully opened position indicated by the line P of FIG. 13, the window glass W is fully opened, and when the open/close position of the window glass W is the fully closed position indicated by the line S of FIG. 13, the window glass W is fully closed. Further, when the open/close position of the window glass W is situated within an area R-S ranging from a position in the vicinity of the fully closed position, which is indicated by the line R of FIG. 13, to the fully closed position, the upper end of the window glass W may be brought into contact with, for example, a weatherstrip provided to the window frame at the time when the window glass W is closed, which leads to a risk that the pinching of the foreign object may be erroneously detected. Such an area R-S, in which the pinching is erroneously detected immediately before the window glass W is fully closed, is herein referred to as an insensitive area. Further, the open/close position indicated by the line R in FIG. 13 is herein referred to as an insensitive area start position. In this embodiment, the arrangement relationship between the projecting portion 72*b* and the operation lever 73 is set so that, when the open/close position of the window glass W is situated within an area ranging from the fully opened position to the insensitive area start position (area P-R), that is, when the open/close position of the window glass W is situated out of the insensitive area, the projecting portion 72*b* of the second gear 72 does not engage with the operation lever 73, and when the open/close position is situated within the insensitive area (area R-S), the projecting portion 72*b* engages with the operation lever 73 and accordingly the operation lever 73 is rotated.

Figure 14:
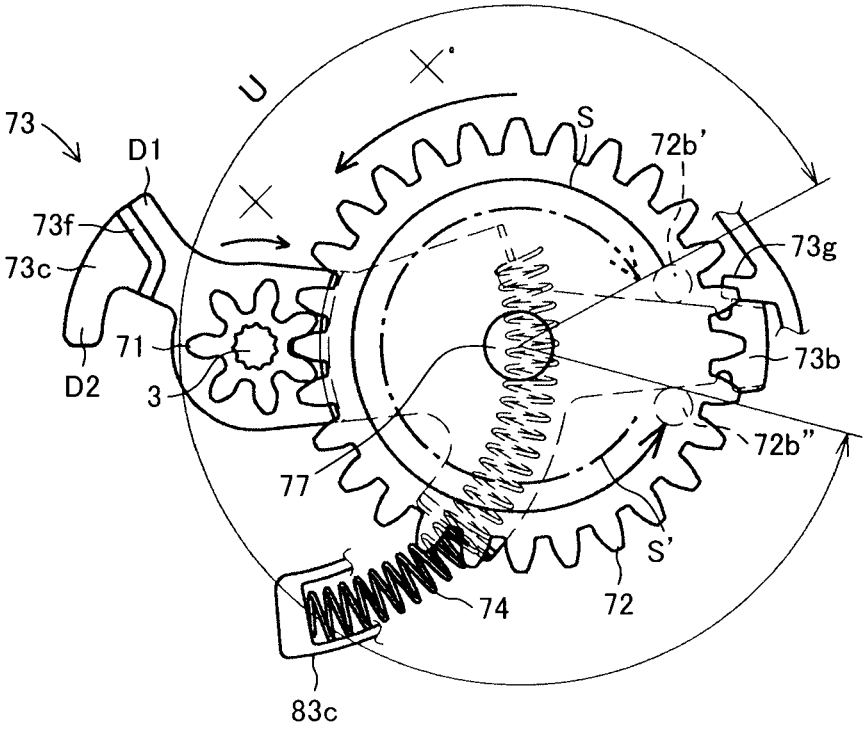
FIG. 14 is a front view illustrating an arrangement relationship among a first gear, a second gear, and the operation lever.

FIG. 14 is a front view illustrating an arrangement relationship among the first gear 71, the second gear 72, and the operation lever 73. As can be seen from FIG. 14, the retention spring 74 biases the operation lever 73 in the X' direction (counterclockwise direction) of FIG. 14. The stopper 73*g* regulates the X'-directional rotation of the operation lever 73 that is caused by the biasing force of the retention spring 74. Through the regulation of rotation, the operation lever 73 is aligned at a position illustrated in FIG. 14. The first gear 71 and the second gear 72 are assembled in a meshing state on an upper surface side of the aligned operation lever 73 (front side of FIG. 14). When the first gear 71 rotates in the X direction through the rotation of the output shaft 3, the window glass W is closed and the second gear 72 meshing with the first gear 71 rotates in the X' direction opposite to the X direction.

When the window glass W is closed in a range from the fully opened position to the insensitive area start position, the projecting portion 72*b* formed on the second gear 72 rotates in the X' direction along the solid line arrow S of FIG. 14 from a position indicated by the reference symbol 72*b*' of FIG. 14 to a position indicated by the reference symbol 72*b*" of FIG. 14. Further, when the window glass W is opened in a range from the insensitive area start position to the fully opened position, the projecting portion 72*b* rotates in a direction opposite to the X' direction along the chain line arrow S' of FIG. 14 from the position indicated by the reference symbol 72*b*" of FIG. 14 to the position indicated by the reference symbol 72*b*' of FIG. 14. The rotational area of the projecting portion 72*b* indicated by the solid line arrow S and the chain line arrow S' is represented by a rotational area U in FIG. 14. The position indicated by the reference symbol 72*b*' corresponds to a position at which the projecting portion 72*b* is brought into contact with the leading end part of the first arm portion 73*b* of the operation lever 73 on the upper side in FIG. 14. The position indicated by the reference symbol 72*b*" corresponds to a position at which the projecting portion 72*b* is brought into contact with the leading end part of the first arm portion 73*b* on the lower side in FIG. 14. Thus, when the rotational position of the projecting portion 72*b* is a position within a rotational area U, the projecting portion 72*b* does not engage with the operation lever 73. In other words, when the open/close position of the window glass W is situated in a range from the fully opened position to the insensitive area start position, that is, when the open/close position of the window glass W is situated out of the insensitive area, the second gear 72 does not engage with the operation lever 73.

Figure 15:
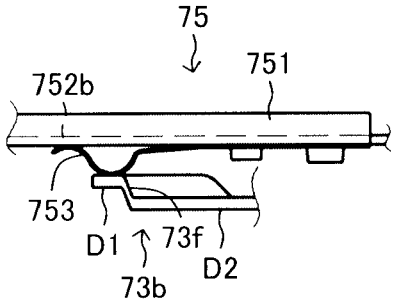
FIG. 15 is a schematic partial side view illustrating a contact state between the insensitive area detection switch and the operation lever in a case where the open/close position of the window glass is situated out of an insensitive area.

When the second gear 72 does not engage with the operation lever 73, the rotational drive force of the output shaft 3 is not transmitted to the operation lever 73, and hence the operation lever 73 is not rotated. FIG. 15 is a schematic partial side view illustrating a contact state between the insensitive area detection switch 75 and the operation lever 73 in a case where the operation lever 73 is not rotated. As illustrated in FIG. 15, the leading end portion of the movable piece 753 of the insensitive area detection switch 75 abuts against the part D1 that is higher in height position than the part D2 across the step 73*f* of the second arm portion 73*c* of the operation lever 73, and is held in contact with the second conductive portion 752*b* formed on the substrate 751 while receiving a pressing force from the part D1. Thus, when the open/close position of the window glass W is situated out of the insensitive area, the switching state of the insensitive area detection switch 75 is the ON state.

When the window glass W is further closed beyond the insensitive area start position, the projecting portion 72*b* of the second gear 72 engages with the operation lever 73 at the position indicated by the reference symbol 72*b*" of FIG. 14. In this case, the second gear 72 is coupled to the operation lever 73, and hence, through the engagement between the projecting portion 72*b* and the operation lever 73, the rotation of the second gear 72 relative to the operation lever 73 is stopped. However, the first gear 71 continues to rotate in the X direction, and hence the second gear 72 is rotated in the X direction about the first gear 71 due to the mesh with the first gear 71. That is, the second gear 72 revolves in the X direction (same direction as the rotational direction of the first gear 71) about the first gear 71 by the rotational force of the first gear 71. Through the X-directional revolution of the second gear 72, the operation lever 73 coupled to the second gear 72 via the coupling pin 77 is rotated in the X direction (clockwise direction) about the first gear 71 (output shaft 3) against the biasing force of the retention spring 74.

Figure 16:
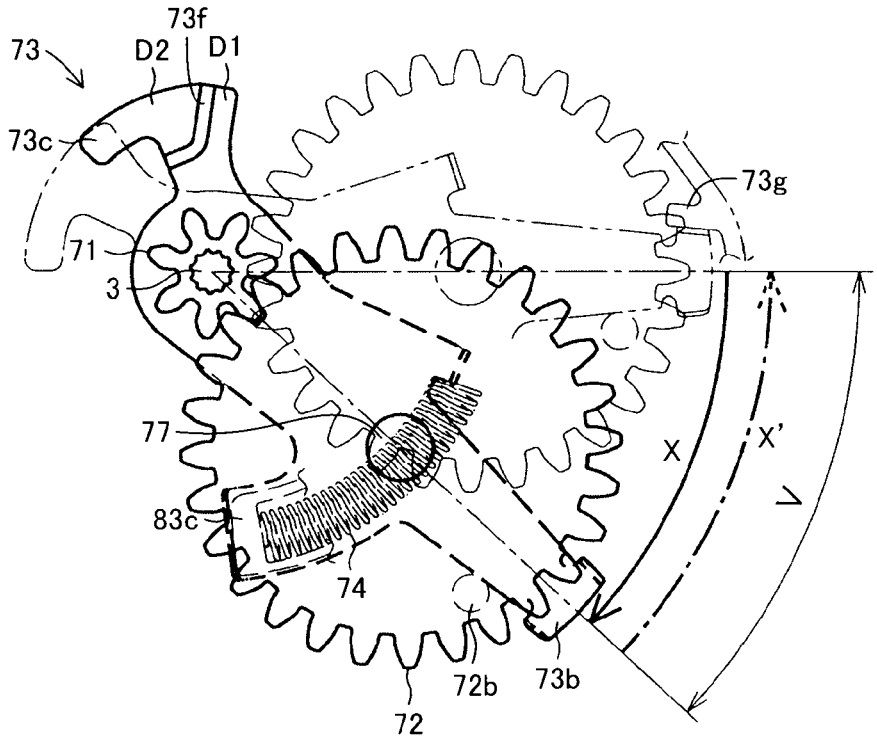
FIG. 16 is a front view illustrating an arrangement relationship among the first gear, the second gear, and the operation lever in a case where the operation lever is rotated.

FIG. 16 is a front view illustrating an arrangement relationship among the first gear 71, the second gear 72, and the operation lever 73 in a case where the operation lever 73 is rotated. When the window glass W is closed in a range from the insensitive area start position to the fully closed position, the operation lever 73 rotates in the X direction about the output shaft 3 from a position indicated by the two-dot chain line of FIG. 16 to a position indicated by the solid line (dotted line in the hidden portion) of FIG. 16, while maintaining the engaging state with the second gear 72. Conversely, when the window glass W is opened in a range from the fully closed position to the insensitive area start position, the operation lever 73 rotates in the X' direction about the output shaft 3 together with the second gear 72 from the position indicated by the solid line of FIG. 16 to the position indicated by the two-dot chain line of FIG. 16. In other words, when the open/close position of the window glass W is situated within the insensitive area, the operation lever 73 engages with the second gear 72 and is rotated within a rotational area V of FIG. 16 about the output shaft 3 together with the second gear 72.

Figure 17:
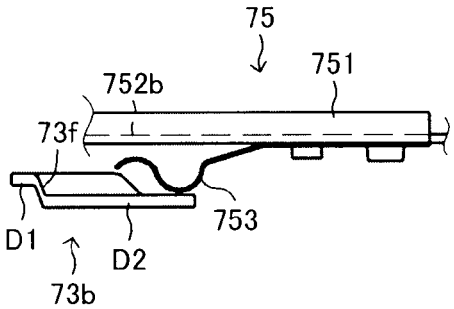
FIG. 17 is a schematic partial side view illustrating a contact state between the insensitive area detection switch and the operation lever in a case where the open/close position of the window glass is situated within the insensitive area.

FIG. 17 is a schematic partial side view illustrating a contact state between the insensitive area detection switch 75 and the operation lever 73 in a case where the operation lever 73 is rotated within the rotational area V. As illustrated in FIG. 17, the movable piece 753 of the insensitive area detection switch 75 abuts against the part D2 that is lower in height position than the part D1 across the step 73*f* of the second arm portion 73*c* immediately after the rotation of the operation lever 73, and is spaced apart from the second conductive portion 752*b*. Thus, when the open/close position of the window glass W is situated within the insensitive area, the switching state of the insensitive area detection switch 75 is the OFF state.

As described above, the insensitive area detection switch 75 performs the switching operation based on the rotational operation of the operation lever 73. Specifically, the switching state of the insensitive area detection switch 75 is the ON state when the operation lever 73 is not rotated, that is, when the open/close position of the window glass W is situated out of the insensitive area, and the switching state of the insensitive area detection switch 75 is the OFF state when the operation lever 73 is rotated, that is, when the open/close position of the window glass W is situated within the insensitive area.

The arrangement relationship between the rotational position of the cam 72*a* formed on the upper surface of the second gear 72 and the reverse operation area detection switch 76 is also associated with the open/close position of the window glass W, which changes along with the rotation of the output shaft 3. The arrangement relationship between the rotational position of the cam 72*a* and the reverse operation area detection switch 76 is determined so that, when the open/close position of the window glass W is situated within an area ranging from a position indicated by the line Q of FIG. 13 (this position is herein referred to as a reverse operation area start position) to the insensitive area start position (this area is herein referred to as a reverse operation area), the switching state of the reverse operation area detection switch 76 becomes the ON state, and when the open/close position of the window glass is situated out of the reverse operation area, the switching state of the reverse operation area detection switch 76 becomes the OFF state.

Figure 18A:
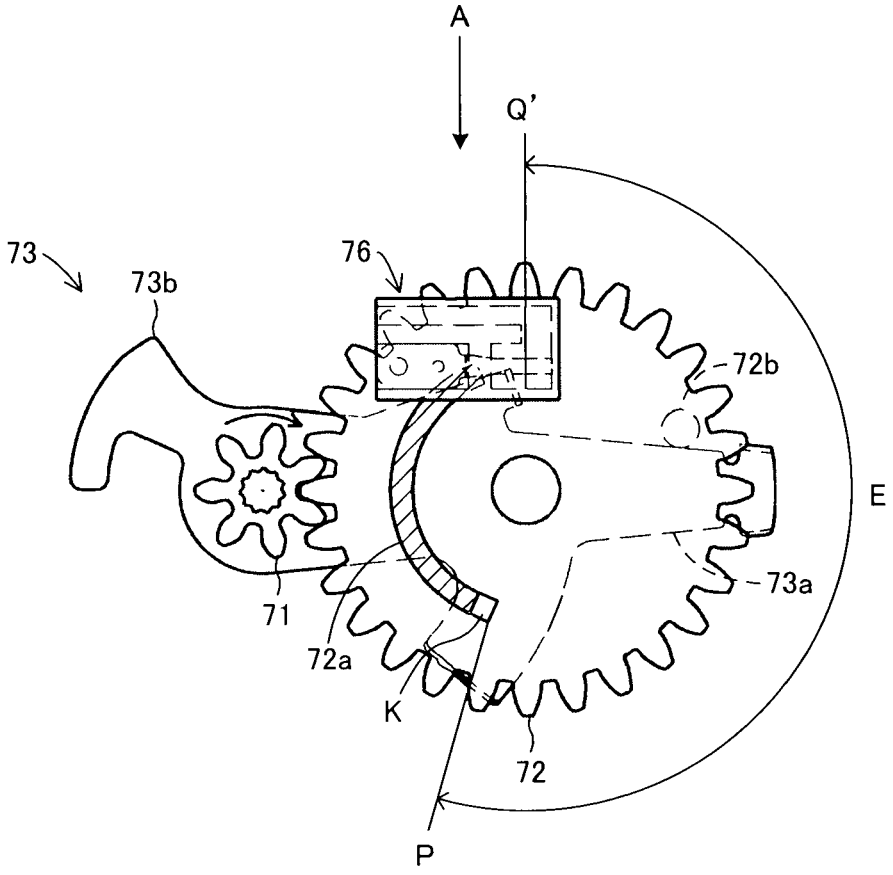
FIG. 18A is a front view illustrating an arrangement relationship between a cam and the reverse operation area detection switch at the time when the open/close position of the window glass is the fully opened position.
Figure 18B:
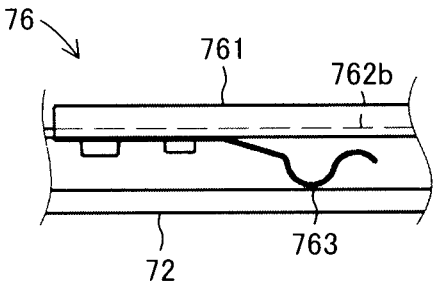
FIG. 18B is a view taken in the arrow A direction of FIG. 18A.

FIG. 18A is a front view illustrating an arrangement relationship between the rotational position of the cam 72*a* and the reverse operation area detection switch 76 at the time when the open/close position of the window glass W is the fully opened position. FIG. 18B is a view taken in the arrow A direction of FIG. 18A. When the open/close position of the window glass W is the fully opened position, the movable piece 763 of the reverse operation area detection switch 76 is held in contact with a part of the second gear 72 at which the cam 72*a* is not formed. At this time, the movable piece 763 is not held in contact with the second conductive portion 762*b*. Thus, in this case, the switching state of the reverse operation area detection switch 76 is the OFF state.

When the window glass W is closed in a range from the fully opened position to a position immediately before the reverse operation area start position, one end portion K of the cam 72*a* in a longitudinal direction thereof rotates from a rotational position indicated by the line P of FIG. 18A to a rotational position indicated by the line Q' of FIG. 18A. Conversely, when the window glass W is opened in a range from the position immediately before the reverse operation area start position to the fully opened position, the end portion K rotates from the rotational position indicated by the line Q' of FIG. 18A to the rotational position indicated by the line P of FIG. 18A. When the rotational position of the end portion K is situated within a rotational area E ranging from the rotational position indicated by the line P to the rotational position indicated by the line Q', the movable piece 763 of the reverse operation area detection switch 76 is not brought into contact with the cam 72*a*. Thus, when the open/close position of the window glass W is situated within the area ranging from the fully opened position to the reverse operation area start position, that is, when the open/close position of the window glass W is situated out of the reverse operation area, the switching state of the reverse operation area detection switch 76 is the OFF state.

Figure 19A:
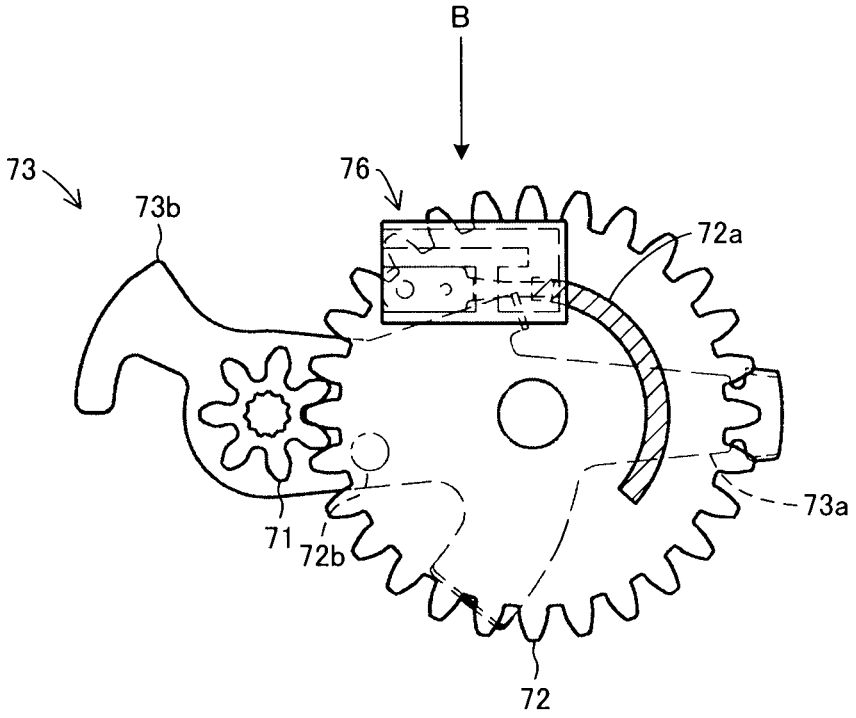
FIG. 19A is a front view illustrating an arrangement relationship between the cam and the reverse operation area detection switch at the time when the open/close position of the window glass is a reverse operation area start position.
Figure 19B:
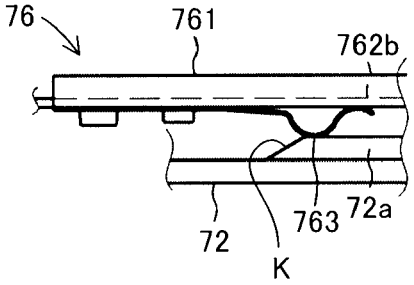
FIG. 19B is a view taken in the arrow B direction of FIG. 19A.

FIG. 19A is a front view illustrating an arrangement relationship between the rotational position of the cam 72*a* and the reverse operation area detection switch 76 at the time when the open/close position of the window glass W is the reverse operation area start position. FIG. 19B is a view taken in the arrow B direction of FIG. 19A. As illustrated in FIGS. 19A and 19B, when the open/close position of the window glass W is the reverse operation area start position, the movable piece 763 of the reverse operation area detection switch 76 starts to override the end portion K of the cam 72*a*. Therefore, the movable piece 763 is pressed by the cam 72*a* and is brought into contact with the second conductive portion 762*b*, with the result that the first conductive portion 762*a* and the second conductive portion 762*b* are brought into conduction. Accordingly, the switching state of the reverse operation area detection switch 76 is switched into the ON state.

Figure 20A:
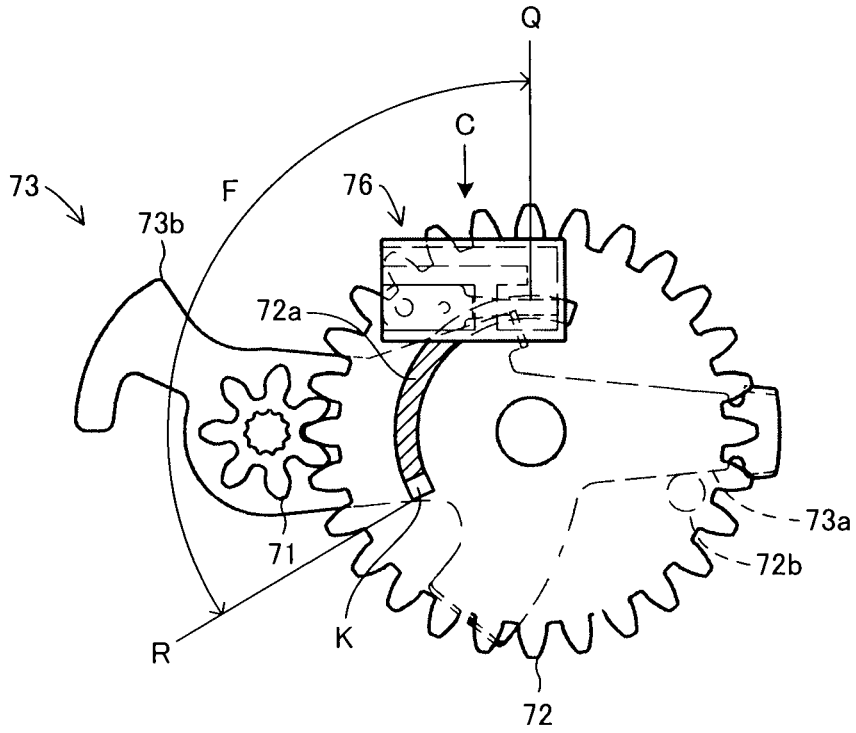
FIG. 20A is a front view illustrating an arrangement relationship between the cam and the reverse operation area detection switch at the time when the open/close position of the window glass is an insensitive area start position.
Figure 20B:
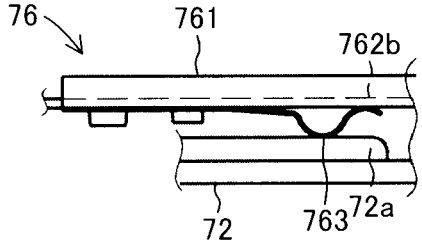
FIG. 20B is a view taken in the arrow C direction of FIG. 20A.

FIG. 20A is a front view illustrating an arrangement relationship between the rotational position of the cam 72*a* and the reverse operation area detection switch 76 at the time when the open/close position of the window glass W is the insensitive area start position. FIG. 20B is a view taken in the arrow C direction of FIG. 20A. As illustrated in FIGS. 20A and 20B, when the open/close position of the window glass W is the insensitive area start position, the movable piece 763 of the reverse operation area detection switch 76 is brought into contact with the cam 72*a*. Therefore, the movable piece 763 is pressed by the cam 72*a* and is brought into contact with the second conductive portion 762*b*, with the result that the first conductive portion 762*a* and the second conductive portion 762*b* are brought into conduction. Accordingly, when the open/close position of the window glass W is the insensitive area start position, the switching state of the reverse operation area detection switch 76 is the ON state.

When the window glass W is closed in a range from the reverse operation area start position to the insensitive area start position, the end portion K of the cam 72*a* rotates from a rotational position indicated by the line Q of FIG. 20A to a rotational position indicated by the line R of FIG. 20A. Conversely, when the window glass W is opened in a range from the insensitive area start position to the reverse operation area start position, the end portion K rotates from the rotational position indicated by the line R of FIG. 20A to the rotational position indicated by the line Q of FIG. 20A. When the rotational position of the end portion K is situated within a rotational area F ranging from the rotational position indicated by the line Q of FIG. 20A to the rotational position indicated by the line R of FIG. 20A, the movable piece 763 of the reverse operation area detection switch 76 is brought into contact with the cam 72*a*. Thus, when the open/close position of the window glass W is situated within the area ranging from the reverse operation area start position to the insensitive area start position, that is, when the open/close position of the window glass W is situated within the reverse operation area, the switching state of the reverse operation area detection switch 76 is the ON state. Note that, when the window glass W is operated in the range from the insensitive area start position to the fully closed position as described above, the second gear 72 revolves about the first gear 71. Thus, in this period, the switching state of the reverse operation area detection switch 76 is the OFF state.

As can be seen from the above description, the window regulator device of this embodiment includes the object pinching detection switch 66, the insensitive area detection switch 75, and the reverse operation area detection switch 76. The object pinching detection switch 66 performs the switching operation based on whether or not the pinching is detected. The insensitive area detection switch 75 performs the switching operation based on whether or not the open/close position of the window glass W is situated within the insensitive area. The reverse operation area detection switch 76 performs the switching operation based on whether or not the open/close position of the window glass W is situated within the reverse operation area. Table 1 provides a summary of the conditions in which the switching states of the respective switches become the ON state, and the conditions in which the switching states of the respective switches become the OFF state.

TABLE 1

| | OFF state | ON state |
|---|---|---|
| Object pinching detection switch | Pinching is not detected | Pinching is detected |
| Insensitive area detection switch | Open/close position of window glass is situated within insensitive area | Open/close position of window glass is situated out of insensitive area |
| Reverse operation area detection switch | Open/close position of window glass is situated out of reverse operation area | Open/close position of window glass is situated within reverse operation area |

As shown in Table 1, when the pinching is detected and the open/close position of the window glass W is situated out of the insensitive area and within the reverse operation area (that is, the open/close position of the window glass W is situated within an area Q-R in FIG. 13), the switching states of all the switches are the ON state. When the switching states of all the switches are the ON state, anti-pinch processing is executed. In this embodiment, the anti-pinch processing corresponds to reverse operation processing of reversing the operation of the window glass W from the closing operation to the opening operation.

According to the embodiment, the anti-pinch processing is not executed in a case where the open/close position of the window glass W is situated out of the reverse operation area, even when the pinching is detected and the open/close position of the window glass W is situated out of the insensitive area. The reason therefor is as follows.

In a case where the arm-type window regulator device is used as in this embodiment, as shown in the graph of FIG. 2, the moment acting on the output shaft changes depending on the rotational position of the lift arm. The largest moment acts on the output shaft particularly when the rotational position of the lift arm is the horizontal position in FIG. 1. When the moment acting on the output shaft is large, the pinching may be erroneously detected due to the moment. In order to prevent such erroneous detection, the anti-pinch processing needs to be inhibited when the moment acting on the output shaft is large. In this embodiment, such a rotational area of the lift arm that the moment acting on the output shaft becomes smaller is determined in advance. Then, an open/close area of the window glass corresponding to the determined rotational area is defined as the reverse operation area. The anti-pinch processing is permitted only when the open/close position of the window glass is situated within the reverse operation area. In this manner, the erroneous detection of the pinching due to the change in moment acting on the output shaft is prevented. Specifically, in the graph of FIG. 2, as the reverse operation area, there is defined an open/close area of the window glass W corresponding to a rotational area of the lift arm ranging from a reverse operation permission position, which is the position between the upper limit position and the horizontal position, to the upper limit position. Then, the cam 72*a* is formed on the second gear 72 so that, when the open/close position of the window glass W is situated within the reverse operation area, the switching state of the reverse operation area detection switch 76 becomes the ON state.

The anti-pinch processing may be executed based on an instruction signal from an ECU. In this case, the switches 66, 75, and 76 are connected to the ECU, and the ECU monitors the switching states of the respective switches. When the switching states of all the switches are the ON state, an instruction signal for executing the anti-pinch processing is output from the ECU to the electric motor. Accordingly, the anti-pinch processing is executed. However, the use of the ECU may lead to a problem of cost increase. In this respect, the window regulator device of this embodiment includes a drive circuit (electric circuit) in which an energization path from the electric power source to the electric motor 2 is formed so as to drive the electric motor 2. The respective switches are integrated into the drive circuit for driving the electric motor 2, and a circuit structure of the drive circuit is devised in a predetermined manner. Accordingly, the anti-pinch processing is executed without using the ECU.

Figure 21:
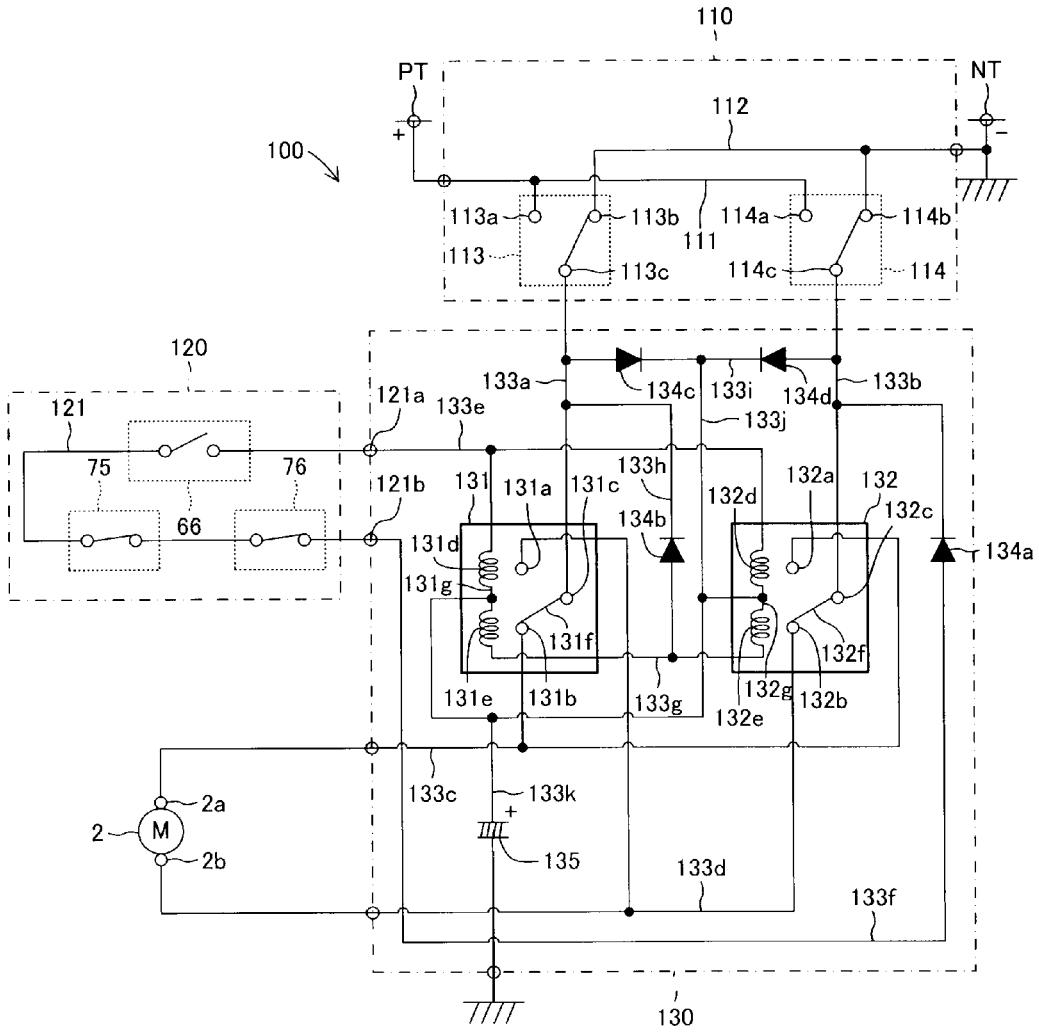
FIG. 21 is a circuit diagram illustrating a drive circuit for energizing an electric motor.

FIG. 21 is a circuit diagram illustrating the drive circuit for driving the electric motor 2. A drive circuit 100 illustrated in FIG. 21 mainly includes a power window switch circuit section 110, a detection switch circuit section 120, and a drive circuit section 130. The power window switch circuit section 110 includes a high voltage line 111 and a low voltage line 112, which serve as the energization path, and a first switch contact point 113 and a second switch contact point 114. The high voltage line 111 is connected to a positive terminal PT of the electric power source, and the low voltage line 112 is connected to a negative terminal NT of the electric power source. Note that, the electric power source is grounded on the negative terminal NT side to a vehicle body or the like.

The first switch contact point 113 is a two-input, one-output switch including a first high voltage side input terminal 113*a*, a first low voltage side input terminal 113*b*, and a first output terminal 113*c*. Similarly, the second switch contact point 114 is a two-input, one-output switch including a second high voltage side input terminal 114*a*, a second low voltage side input terminal 114*b*, and a second output terminal 114*c*. The positive terminal of the electric power source is connected to the first high voltage side input terminal 113*a* and the second high voltage side input terminal 114*a* via the high voltage line 111, and the negative terminal of the electric power source is connected to the first low voltage side input terminal 113*b* and the second low voltage side input terminal 114*b* via the low voltage line 112. Note that, a connection state between the input and output terminals of those switch contact points is selectively switched through an operation of an operation switch (not shown) for opening and closing the window mounted onto the vehicle. The operation position of the operation switch is switchable among a neutral position, a window closing position, and a window opening position. When the operation switch is not operated, the operation position is the neutral position. When the window glass is closed, the operation switch is operated so that the operation position becomes the window closing position. When the window glass is opened, the operation switch is operated so that the operation position becomes the window opening position.

When the operation switch is not operated, that is, when the operation position of the operation switch is the neutral position, the first low voltage side input terminal 113*b* of the first switch contact point 113 is connected to the first output terminal 113*c*, and the second low voltage side input terminal 114*b* of the second switch contact point 114 is connected to the second output terminal 114*c*. When the operation position of the operation switch is the window closing position, the first high voltage side input terminal 113*a* of the first switch contact point 113 is connected to the first output terminal 113*c*, and the second low voltage side input terminal 114*b* of the second switch contact point 114 is connected to the second output terminal 114*c*. When the operation position of the operation switch is the window opening position, the first low voltage side input terminal 113*b* of the first switch contact point 113 is connected to the first output terminal 113*c*, and the second high voltage side input terminal 114*a* of the second switch contact point 114 is connected to the second output terminal 114*c*.

The detection switch circuit section 120 includes the object pinching detection switch 66, the insensitive area detection switch 75, the reverse operation area detection switch 76, and a switch line 121 serving as an energization path connecting those switches in series. When the switching states of all the switches are the conductive state (ON state), one end 121*a* and another end 121*b* of the switch line 121 are brought into conduction.

The drive circuit section 130 includes a first latching relay 131 and a second latching relay 132. In this embodiment, those latching relays 131 and 132 are two-coil latching relays. The first latching relay 131 includes a first reverse rotation terminal 131*a*, a first forward rotation terminal 131*b*, a first movable terminal 131*c*, a first reverse rotation excitation coil 131*d*, a first forward rotation excitation coil 131*e*, a first movable piece 131*f*, and a first connection lead wire 131*g*. The first reverse rotation excitation coil 131*d* and the first forward rotation excitation coil 131*e* are connected on one end sides thereof by the first connection lead wire 131*g*. The first movable piece 131*f* operates in accordance with energization states of the first reverse rotation excitation coil 131*d* and the first forward rotation excitation coil 131*e*. When the first reverse rotation excitation coil 131*d* is energized, the first movable piece 131*f* connects the first reverse rotation terminal 131*a* and the first movable terminal 131*c* to each other. When the first forward rotation excitation coil 131*e* is energized, the first movable piece 131*f* connects the first forward rotation terminal 131*b* and the first movable terminal 131*c* to each other.

The second latching relay 132 includes a second reverse rotation terminal 132*a*, a second forward rotation terminal 132*b*, a second movable terminal 132*c*, a second reverse rotation excitation coil 132*d*, a second forward rotation excitation coil 132*e*, a second movable piece 132*f*, and a second connection lead wire 132*g*. The second reverse rotation excitation coil 132*d* and the second forward rotation excitation coil 132*e* are connected on one end sides thereof by the second connection lead wire 132*g*. The second movable piece 132*f* operates in accordance with energization states of the second reverse rotation excitation coil 132*d* and the second forward rotation excitation coil 132*e*. When the second reverse rotation excitation coil 132*d* is energized, the second movable piece 132*f* connects the second reverse rotation terminal 132*a* and the second movable terminal 132*c* to each other. When the second forward rotation excitation coil 132*e* is energized, the second movable piece 132*f* connects the second forward rotation terminal 132*b* and the second movable terminal 132*c* to each other.

Hereinafter, the switching state in which the first forward rotation terminal 131*b* and the first movable terminal 131*c* of the first latching relay 131 are connected to each other (state illustrated in FIG. 21) is referred to as a normal state, and the switching state in which the first reverse rotation terminal 131*a* and the first movable terminal 131*c* are connected to each other is referred to as a reverse state. Similarly, the switching state in which the second forward rotation terminal 132*b* and the second movable terminal 132*c* of the second latching relay 132 are connected to each other (state illustrated in FIG. 21) is referred to as a normal state, and the switching state in which the second reverse rotation terminal 132*a* and the second movable terminal 131*c* are connected to each other is referred to as a reverse state. Normally, the switching states of those latching relays are the normal state.

The drive circuit section 130 includes a first line 133*a*, a second line 133*b*, a third line 133*c*, and a fourth line 133*d* as electric power supply lines to the electric motor 2. The first line 133*a* electrically connects together the first output terminal 113*c* of the first switch contact point 113 and the first movable terminal 131*c* of the first latching relay 131. The second line 133*b* electrically connects together the second output terminal 114*c* of the second switch contact point 114 and the second movable terminal 132*c* of the second latching relay 132. Thus, the first movable terminal 131*c* is connected to the first output terminal 113*c* via the first line 133*a*, and the second movable terminal 132*c* is connected to the second output terminal 114*c* via the second line 133*b*.

The third line 133*c* is electrically connected at one end thereof to a first electric power supply terminal 2*a* that is one electric power supply terminal of the electric motor 2. Further, the third line 133*c* is branched on another end side thereof into two lines. One of the branched lines is connected to the first forward rotation terminal 131*b* of the first latching relay 131, and another of the branched lines is connected to the second reverse rotation terminal 132*a* of the second latching relay 132. The fourth line 133*d* is electrically connected at one end thereof to a second electric power supply terminal 2*b* that is another electric power supply terminal of the electric motor 2. Further, the fourth line 133*d* is branched on another end side thereof into two lines. One of the branched lines is connected to the first reverse rotation terminal 131*a* of the first latching relay 131, and another of the branched lines is connected to the second forward rotation terminal 132*b* of the second latching relay 132. Thus, the first forward rotation terminal 131*b* of the first latching relay 131 is connected to the first electric power supply terminal 2*a* via the third line 133*c*, and the first reverse rotation terminal 131*a* is connected to the second electric power supply terminal 2*b* via the fourth line 133*d*. Further, the second reverse rotation terminal 132*a* of the second latching relay 132 is connected to the first electric power supply terminal 2*a* via the third line 133*c*, and the second forward rotation terminal 132*b* is connected to the second electric power supply terminal 2*b* via the fourth line 133*d*.

Note that, the electric motor 2 includes the first electric power supply terminal 2*a* and the second electric power supply terminal 2*b*, and generates the rotational drive force for opening and closing the window glass W through the energization between the electric power supply terminals of the electric motor 2. The electric motor 2 is rotatable in forward and reverse directions. When a current flows from the first electric power supply terminal 2*a* toward the second electric power supply terminal 2*b*, the electric motor 2 rotates in the forward direction, and when a current flows from the second electric power supply terminal 2*b* toward the first electric power supply terminal 2*a*, the electric motor 2 rotates in the reverse direction. When the electric motor 2 is driven to rotate in the forward direction, the window glass W is closed, and when the electric motor 2 is driven to rotate in the reverse direction, the window glass W is opened.

Further, the drive circuit section 130 includes a fifth line 133*e* and a sixth line 133*f*. The fifth line 133*e* is connected to the one end 121*a* of the switch line 121 of the detection switch circuit section 120. Further, the fifth line 133*e* is branched midway into two lines. One of the branched lines is connected to another end side of the first reverse rotation excitation coil 131*d* of the first latching relay 131, and another of the branched lines is connected to another end side of the second reverse rotation excitation coil 132*d* of the second latching relay 132. The fifth line 133*e* corresponds to a second relay line of the present invention.

The sixth line 133*f* connects the another end 121*b* side of the switch line 121 and the second line 133*b* to each other. As can be seen from FIG. 21, the fifth line 133*e* (second relay line) is connected to the second output terminal 114*c* of the second switch contact point 114 via the sixth line 133*f* and the switch line 121. The switch line 121 and the sixth line 133*f* correspond to a third relay line of the present invention.

Further, the drive circuit section 130 includes a seventh line 133*g* and an eighth line 133*h*. The seventh line 133*g* connects together another end side of the first forward rotation excitation coil 131*e* of the first latching relay 131 and another end side of the second forward rotation excitation coil 132*e* of the second latching relay 132. The eighth line 133*h* is connected at one end thereof to the seventh line 133*g*, and is connected at another end thereof to the first line 133*a*. As can be seen from FIG. 21, the another end side of the first forward rotation excitation coil 131*e* of the first latching relay 131 and the another end side of the second forward rotation excitation coil 132*e* of the second latching relay 132 are connected to the first output terminal 113*c* of the first switch contact point 113 via the seventh line 133*g* and the eighth line 133*h*. The seventh line 133*g* and the eighth line 133*h* correspond to a fourth relay line of the present invention.

Further, the drive circuit section 130 includes a ninth line 133*i*, a tenth line 133*j*, and an eleventh line 133*k*. The ninth line 133*i* is a line connecting the first line 133*a* and the second line 133*b* to each other. In this embodiment, the ninth line 133*i* is connected on one end side thereof to a part of the first line 133*a* between a junction point to the output terminal 113*c* of the first switch contact point 113 and a junction point to the eighth line 133*h*. Further, the ninth line 133*i* is connected on another end side thereof to a part of the second line 133*b* between a junction point to the output terminal 114*c* of the second switch contact point 114 and a junction point to the sixth line 133*f*. The tenth line 133*j* is connected at one end thereof to the ninth line 133*i*. The tenth line 133*j* is branched on another end side thereof into two lines. One of the branched lines is connected to the first connection lead wire 131*g* of the first latching relay 131, and another of the branched lines is connected to the second connection lead wire 132*g* of the second latching relay 132.

A line formed of the tenth line 133*j* and a part of the ninth line 133*i* ranging from a location connected to the first line 133*a* to a location connected to the tenth line 133*j*, that is, a line connecting the first output terminal 113*c* of the first switch contact point 113 to the first connection lead wire 131*g* and the second connection lead wire 132*g*, corresponds to a first relay line of the present invention. Further, a part of the ninth line 133*i* ranging from a location connected to the second line 133*b* to the location connected to the tenth line 133*j*, that is, a line connecting the first relay line to the second output terminal 114*c* of the second switch contact point 114, corresponds to a fifth relay line of the present invention.

The eleventh line 133*k* is connected on one end side thereof to the tenth line 133*j* (first relay line). Further, the eleventh line 133*k* is grounded on another end side thereof to the vehicle body. In this case, the electric power source is also grounded on the negative terminal NT side, and hence the another end side of the eleventh line 133*k* and the negative terminal NT of the electric power source have the same potential. That is, the eleventh line 133*k* may be regarded as a line electrically connecting the tenth line 133*j* (first relay line) to the negative terminal side of the electric power source. The eleventh line 133*k* corresponds to a connection line of the present invention. Further, a capacitor 135 is interposed in the eleventh line 133*k*.

Further, as can be seen from FIG. 21, a first diode 134*a* is mounted onto the sixth line 133*f* (third relay line). The first diode 134*a* blocks a current flowing from a side which the sixth line 133*f* is connected to the second line 133*b* (that is, a side connected to the second output terminal 114*c*) toward the fifth line 133*e* (second relay line) via the sixth line 133*f* and the switch line 121, and allows a current flowing in a direction opposite thereto.

Further, a second diode 134*b* is mounted onto the eighth line 133*h* (fourth relay line). The second diode 134*b* blocks a current flowing from a side which the eighth line 133*h* is connected to the first line 133*a* (that is, a side connected to the first output terminal 113*c*) to a side connected to the seventh line 133*g*, and allows a current flowing in a direction opposite thereto. As described above, the seventh line 133*g* is connected to the another end side of the first forward rotation excitation coil 131*e* of the first latching relay 131 and the another end side of the second forward rotation excitation coil 132*e* of the second latching relay 132. Thus, the second diode 134*b* corresponds to a diode, which is mounted onto the fourth relay line formed of the seventh line 133*g* and the eighth line 133*h*, and blocks a current flowing from a side connected to the first output terminal 113*c* toward a side connected to the another end side of the first forward rotation excitation coil 131*e* and the another end side of the second forward rotation excitation coil 132*e*.

Further, a third diode 134*c* and a fourth diode 134*d* are mounted onto the ninth line 133*i*. The third diode 134*c* is mounted between the one end of the ninth line 133*i* (end portion connected to the first line 133*a*) and the part of the ninth line 133*i* connected to the tenth line 133*j*, that is, the third diode 134*c* is mounted onto a part of the ninth line 133*i* that serves as the first relay line. The mounting position of the third diode 134*c* in the first relay line corresponds to a position between a location in which the first relay line is connected to the eleventh line 133*k* and a location in which the first relay line is connected to the first output terminal 113*c* via the first line 133*a*. The fourth diode 134*d* is provided between the another end of the ninth line 133*i* (end portion connected to the second line 133*b*) and the part of the ninth line 133*i* connected to the tenth line 133*j*, that is, the fourth diode 134*d* is provided to a part of the ninth line 133*i* that serves as the fifth relay line. As can be seen from FIG. 21, the third diode 134*c* and the fourth diode 134*d* are provided while sandwiching a junction point between the ninth line 133*i* and the tenth line 133*j*.

The third diode 134*c* blocks a current flowing from a side of the connection point where the eleventh line 133*k* is connected to the tenth line 133*j* toward the first output terminal 113*c* via the tenth line 133*j* and the ninth line 133*i* (first relay line), and allows a current flowing in a direction opposite thereto. That is, the third diode 134*c* blocks a current flowing from a side of the first relay line, to which the eleventh line 133*k* is connected, toward a side connected to the first output terminal 113*c*. The fourth diode 134*d* blocks a current flowing from a side of the connection point where the tenth line 133*j* is connected to the ninth line 133*i* (side connected to the first relay line) toward the another end side of the ninth line 133*i* (side connected to the second output terminal 114*c*), and allows a current flowing in a direction opposite thereto.

In such a circuit structure, when the operation switch is not operated (when the switching state of the operation switch is the neutral state), as described above, the first low voltage side input terminal 113*b* of the first switch contact point 113 is connected to the first output terminal 113*c*, and the second low voltage side input terminal 114*b* of the second switch contact point 114 is connected to the second output terminal 114*c*. When the respective input terminals and output terminals are connected in this manner, the high voltage line 111 connected to the first high voltage side input terminal 113*a* and the second high voltage side input terminal 114*a* is disconnected from the electric motor 2, and hence the electric power is not supplied from the positive terminal PT side of the electric power source to the electric motor 2. Therefore, the window glass W is not opened or closed.

Figure 22:
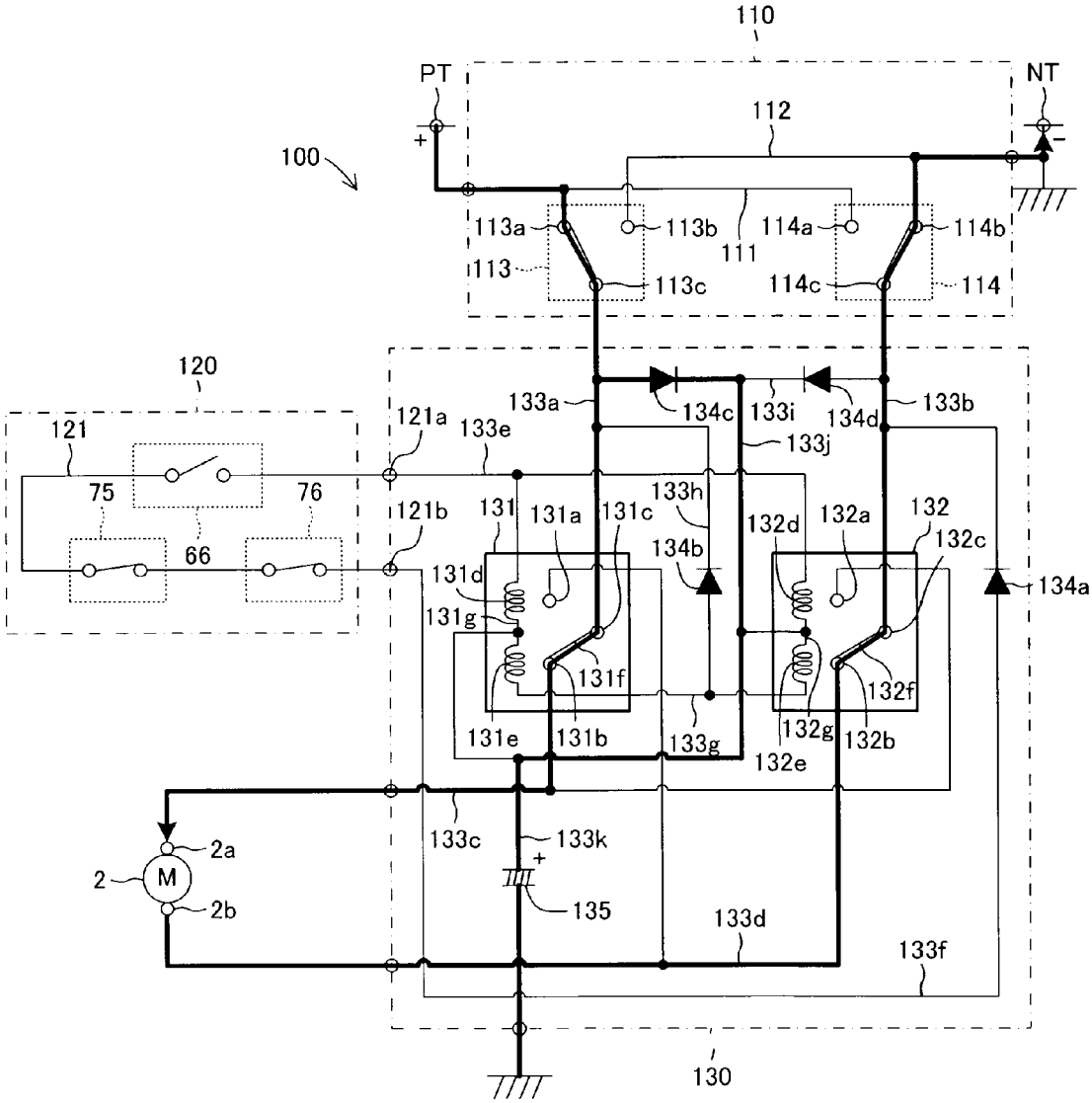
FIG. 22 is a circuit diagram of the drive circuit, illustrating an electric power supply path to the electric motor in a case where an operation switch is operated so that a window is closed.

Further, when the operation switch is operated and the operation position of the operation switch is the window closing position, as illustrated in FIG. 22, the first high voltage side input terminal 113*a* and the first output terminal 113*c* of the first switch contact point 113 are connected to each other, and the second low voltage side input terminal 114*b* and the second output terminal 114*c* of the second switch contact point 114 are connected to each other. Accordingly, the high voltage line 111 is connected to the first line 133*a* via the first switch contact point 113. At this time, the switching state of the first latching relay 131 is set to the normal state (state in which the first forward rotation terminal 131*b* and the first movable terminal 131*c* are connected to each other). Therefore, the first line 133*a* and the third line 133*c* are connected to each other via the first latching relay 131. Thus, the positive terminal PT of the electric power source is electrically connected to the first electric power supply terminal 2*a* of the electric motor 2 via the high voltage line 111, the first switch contact point 113, the first line 133*a*, the first latching relay 131, and the third line 133*c*.

Further, the low voltage line 112 is connected to the second line 133*b* via the second switch contact point 114. At this time, the switching state of the second latching relay 132 is set to the normal state (state in which the second forward rotation terminal 132*b* and the second movable terminal 132*c* are connected to each other), and hence the second line 133*b* and the fourth line 133*d* are connected to each other via the second latching relay 132. Thus, the negative terminal NT of the electric power source is electrically connected to the second electric power supply terminal 2*b* of the electric motor 2 via the low voltage line 112, the second switch contact point 114, the second line 133*b*, the second latching relay 132, and the fourth line 133*d*.

Therefore, an electric power supply path as indicated by the thick line in FIG. 22 is formed, and the electric power is supplied from the electric power source to the electric motor 2. At this time, a current flows from the first electric power supply terminal 2*a* to the second electric power supply terminal 2*b* of the electric motor 2. When a current flows in this direction, the electric motor 2 rotates in the forward direction. Through the forward rotation of the electric motor 2, the window glass W is closed. Note that, the fourth diode 134*d* prevents a short circuit of a current via the ninth line 133*i*.

Further, a current flowing through the first line 133*a* from the high voltage line 111 via the first switch contact point 113 is split into the ninth line 133*i* side, and further flows through the tenth line 133*j* (first relay line) and the eleventh line 133*k*. Due to the current flowing through the eleventh line 133*k*, the capacitor 135 interposed in the eleventh line 133*k* is charged.

Figure 23:
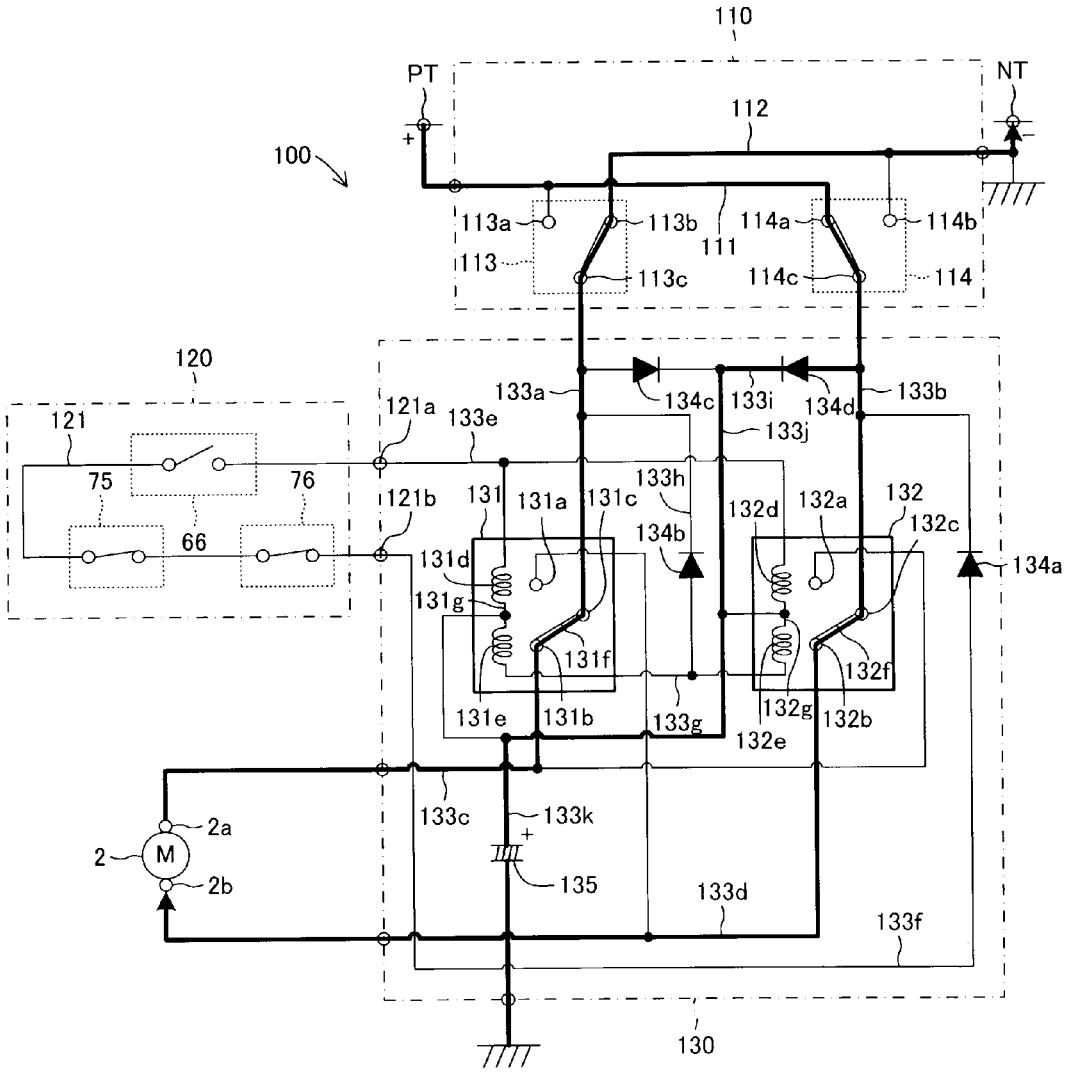
FIG. 23 is a circuit diagram of the drive circuit, illustrating an electric power supply path to the electric motor in a case where the operation switch is operated so that the window is opened.

When the operation switch is operated and the operation position of the operation switch is the window opening position, as illustrated in FIG. 23, the first low voltage side input terminal 113*b* and the first output terminal 113*c* of the first switch contact point 113 are connected to each other, and the second high voltage side input terminal 114*a* and the second output terminal 114*c* of the second switch contact point 114 are connected to each other. Accordingly, the high voltage line 111 is connected to the second line 133*b* via the second switch contact point 114. Further, the switching state of the second latching relay 132 is set to the normal state, and hence the second line 133*b* and the fourth line 133*d* are connected to each other via the second latching relay 132. Thus, the positive terminal PT of the electric power source is electrically connected to the second electric power supply terminal 2*b* of the electric motor 2 via the high voltage line 111, the second switch contact point 114, the second line 133*b*, the second latching relay 132, and the fourth line 133*d*.

Further, the low voltage line 112 is connected to the first line 133*a* via the first switch contact point 113. At this time, the switching state of the first latching relay 131 is set to the normal state, and hence the first line 133*a* and the third line 133*c* are connected to each other via the first latching relay 131. Thus, the negative terminal NT of the electric power source is electrically connected to the first electric power supply terminal 2*a* of the electric motor 2 via the low voltage line 112, the first switch contact point 113, the first line 133*a*, the first latching relay 131, and the third line 133*c*.

Therefore, an electric power supply path as indicated by the thick line in FIG. 23 is formed, and the electric power is supplied from the electric power source to the electric motor 2. At this time, as illustrated in FIG. 23, a current flows from the second electric power supply terminal 2*b* toward the first electric power supply terminal 2*a* of the electric motor 2. When a current flows in this direction, the electric motor 2 rotates in the reverse direction. Through the reverse rotation of the electric motor 2, the window glass W is opened. Note that, the third diode 134*c* prevents a short circuit of a current via the ninth line 133*i*. Further, a current flowing through the second line 133*b* from the high voltage line 111 via the second switch contact point 114 is split into the ninth line 133*i* side, and further flows through the tenth line 133*j* and the eleventh line 133*k*. Due to the current flowing through the eleventh line 133*k*, the capacitor 135 is charged.

Figure 24:
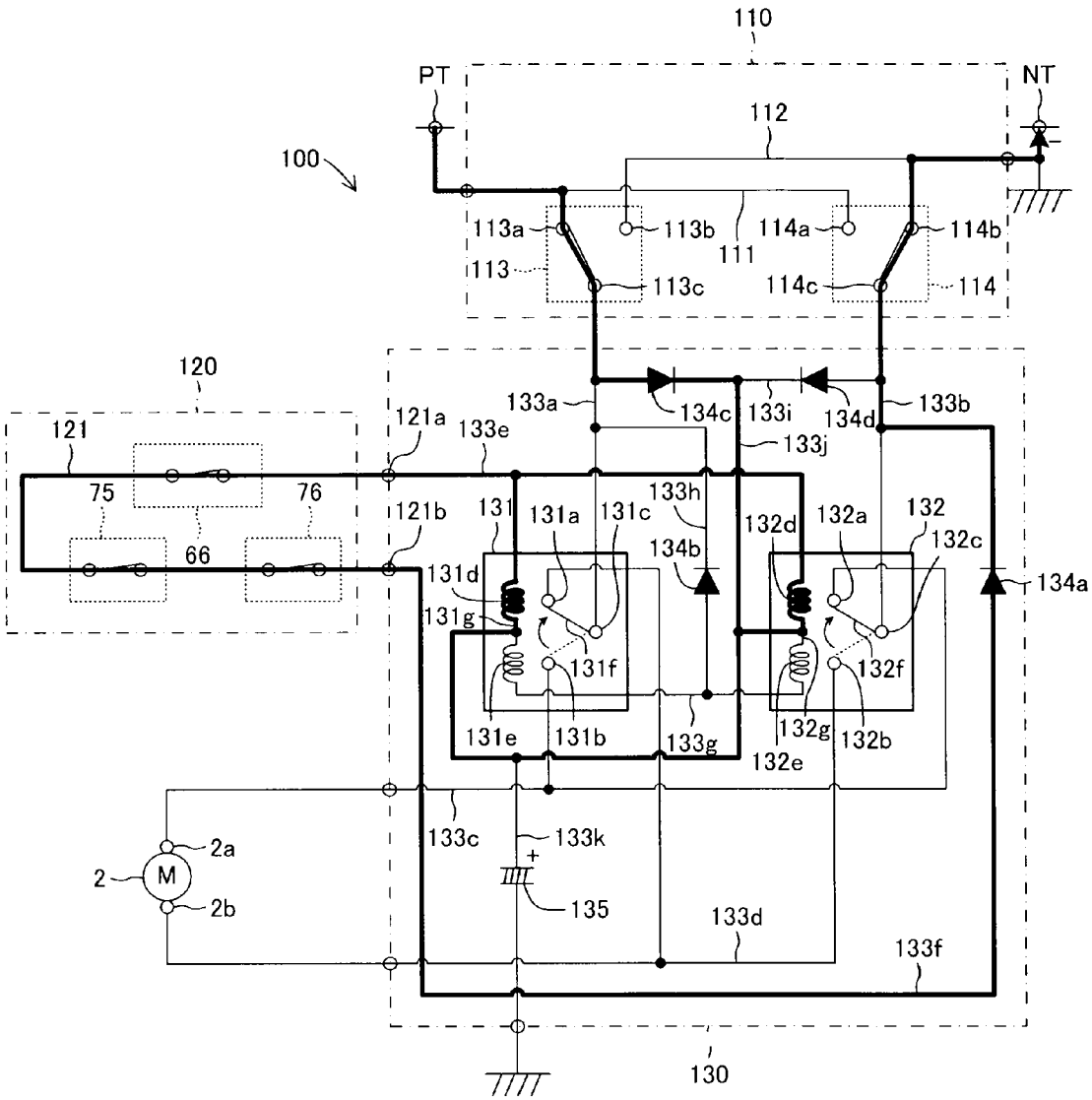
FIG. 24 is a circuit diagram of the drive circuit, illustrating an energization path for switching between a first latching relay and a second latching relay at the time of object pinching detection.

When the pinching of the foreign object is detected at the time of the closing operation of the window glass W (when the operation position of the operation switch is the window closing position), the switching state of the object pinching detection switch 66 becomes the conductive (ON) state. At this time, when the switching state of the insensitive area detection switch 75 is the conductive (ON) state and the switching state of the reverse operation area detection switch 76 is also the conductive (ON) state, both the ends 121*a* and 121*b* of the switch line 121 of the detection switch circuit section 120 are brought into conduction. Accordingly, as illustrated in FIG. 24, there is formed a relay circuit connecting the high voltage line 111, the first switch contact point 113, the first line 133*a*, the ninth line 133*i* and the tenth line 133*j* (first relay line), the first reverse rotation excitation coil 131*d* and the second reverse rotation excitation coil 132*d*, the fifth line 133*e* (second relay line), the switch line 121 and the sixth line 133*f* (third relay line), the second line 133*b*, the second switch contact point 114, and the low voltage line 112. Thus, the first reverse rotation excitation coil 131*d* and the second reverse rotation excitation coil 132*d* are energized. Through the energization of the first reverse rotation excitation coil 131*d*, the first movable piece 131*f* is operated so that the first reverse rotation terminal 131*a* and the first movable terminal 131*c* are connected to each other. Through the energization of the second reverse rotation excitation coil 132*d*, the second movable piece 132*f* is operated so that the second reverse rotation terminal 132*a* and the second movable terminal 132*c* are connected to each other. In this manner, the switching states of the first and second latching relays 131 and 132 are switched from the normal state to the reverse state. Note that, at this time, the second diode 134*b* interposed in the eighth line 133*h* blocks a current flowing from a side of the eighth line 133*h* and the seventh line 133*g* (fourth relay line) toward the fifth line 133*e* (second relay line) side. Through the blocking of current, the energization of the first forward rotation excitation coil 131*e* and the second forward rotation excitation coil 132*e* is prevented.

Figure 25:
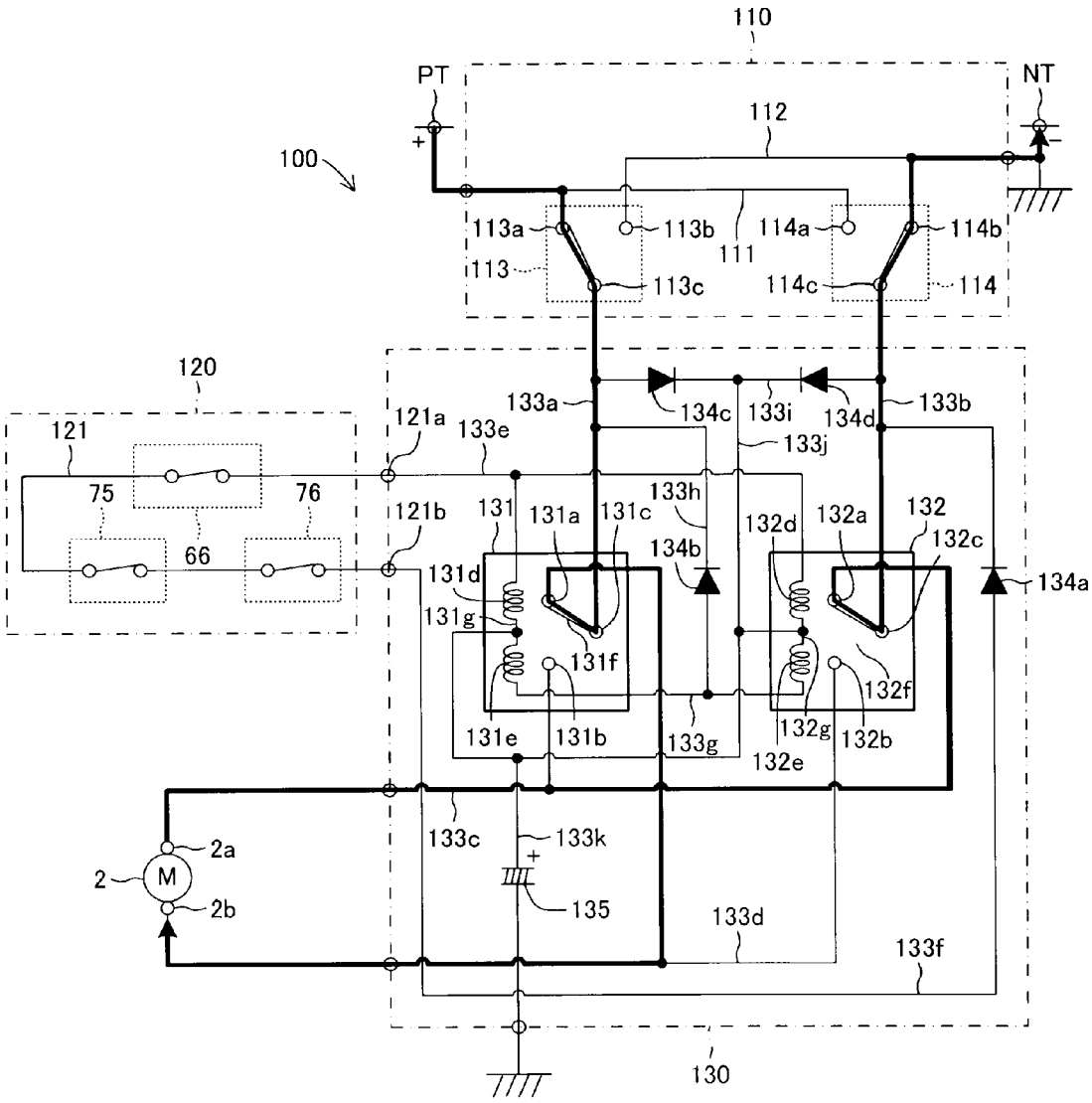
FIG. 25 is a circuit diagram of the drive circuit, illustrating an electric power supply path to the electric motor at the time of anti-pinch processing.

Through the above-mentioned switching operation of the latching relays 131 and 132, the first line 133*a* is connected to the fourth line 133*d* via the first latching relay 131, and the second line 133*b* is connected to the third line 133*c* via the second latching relay 132. Therefore, the electric power supply path from the electric power source to the electric motor 2 changes from the path of FIG. 22 to the path of FIG. 25. As illustrated in FIG. 25, the positive terminal PT of the electric power source is connected to the second electric power supply terminal 2*b* of the electric motor 2 via the high voltage line 111, the first switch contact point 113, the first line 133*a*, the first latching relay 131, and the fourth line 133*d*. Meanwhile, the negative terminal NT of the electric power source is connected to the first electric power supply terminal 2*a* of the electric motor 2 via the low voltage line 112, the second switch contact point 114, the second line 133*b*, the second latching relay 132, and the third line 133*c*. Therefore, the direction of the electric power supply to the electric motor 2 is reversed, and the electric motor 2 rotates in the reverse direction. Through the reverse rotation of the electric motor 2, the window glass W is reversely operated. That is, when the pinching is detected, the window glass W is opened even in a case where the operation position of the operation switch is the window closing position. Note that, at this time, the first diode 134*a* prevents a current from flowing from the sixth line 133*f* (third relay line) via the switch line 121 to the fifth line 133*e* (second relay line) side.

Figure 26:
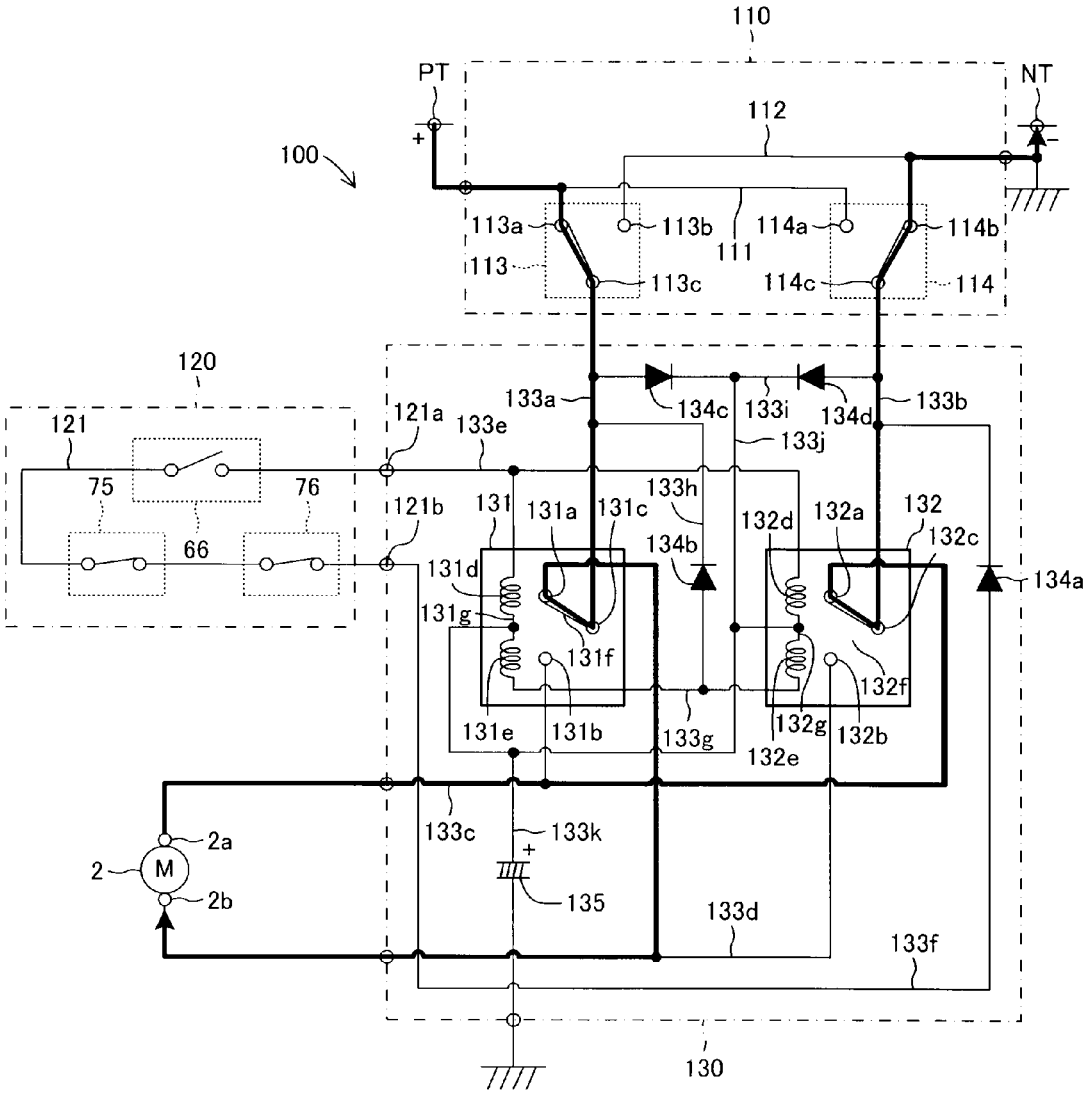
FIG. 26 is a circuit diagram of the drive circuit, illustrating the electric power supply path to the electric motor at the time of anti-pinch processing.

When the window glass W is opened in response to the detection of the pinching, the pinching state is eliminated, and hence the switching state of the object pinching detection switch 66 becomes the non-conductive (OFF) state again. Then, the relay circuit indicated by the thick line in FIG. 24 is not formed, but due to magnetic forces of permanent magnets or the like, the first and second latching relays 131 and 132 maintain the connection between the first reverse rotation terminal 131*a* and the first movable terminal 131*c* and the connection between the second reverse rotation terminal 132*a* and the second movable terminal 132*c*, respectively, also after the energization of the coils is finished. Thus, even after the switching state of the object pinching detection switch 66 becomes the OFF state, as long as the operation position of the operation switch is the window closing position, the electric power supply path to the electric motor 2 does not change as illustrated in FIG. 26. Thus, the reverse operation (opening operation) of the window glass W is continued.

Figure 27:
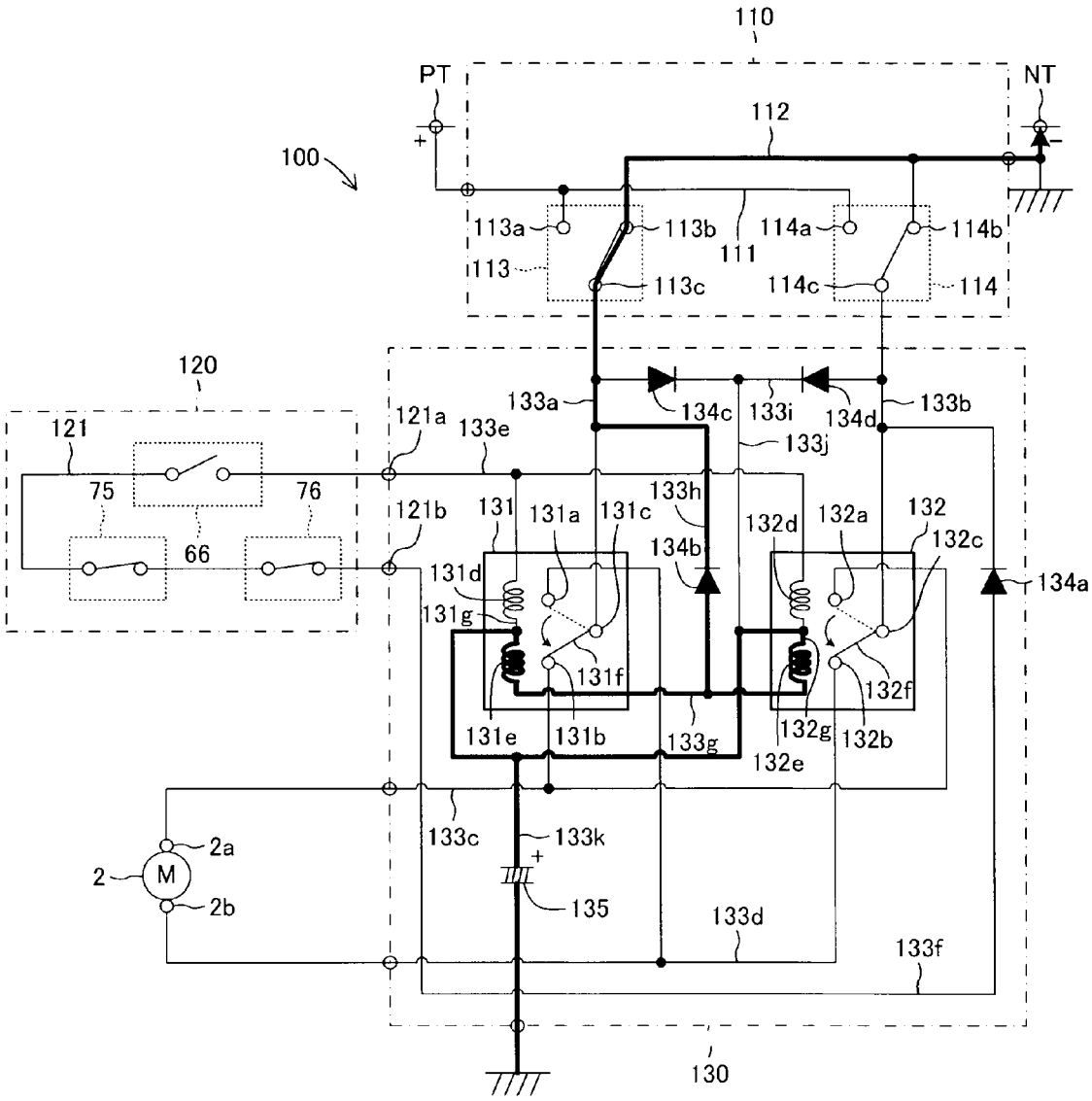
FIG. 27 is a circuit diagram of the drive circuit, illustrating a path for discharging electricity accumulated in the capacitor.

After that, when the operation of the operation switch is stopped, the operation position of the operation switch becomes the neutral position. In this case, as illustrated in FIG. 27, the first low voltage side input terminal 113*b* of the first switch contact point 113 is connected to the first output terminal 113*c*, and the second low voltage side input terminal 114*b* of the second switch contact point 114 is connected to the second output terminal 114*c*. Accordingly, the positive terminal PT of the electric power source and the electric motor 2 are electrically disconnected so that the reverse operation (opening operation) of the window glass W is stopped. At this time, as indicated by the thick line in FIG. 27, electricity accumulated in the capacitor 135 are discharged to the negative terminal NT side of the electric power source via the eleventh line 133*k* (connection line), the tenth line 133*j* (first relay line), the first forward rotation excitation coil 131*e* and the second forward rotation excitation coil 132*e*, the seventh line 133*g* and the eighth line 133*h* (fourth relay line), the first line 133*a*, the first switch contact point 113, and the low voltage line 112. Therefore, the first forward rotation excitation coil 131*e* and the second forward rotation excitation coil 132*e* are energized. Through the energization of the first forward rotation excitation coil 131*e*, the first movable piece 131*f* is operated so that the first forward rotation terminal 131*b* and the first movable terminal 131*c* are connected to each other. Through the energization of the second forward rotation excitation coil 132*e*, the second movable piece 132*f* is operated so that the second forward rotation terminal 132*b* and the second movable terminal 132*c* are connected to each other. In this manner, when the operation of the operation switch is stopped after the reverse operation, the switching states of both the latching relays are switched from the reverse state to the normal state. This switching state is maintained until the reverse operation is performed subsequently (that is, until the switching states of all the switches 66, 75, and 76 become the ON state subsequently). Note that, the third diode 134*c* prevents a discharge current of the capacitor 135 from flowing directly to the first switch contact point 113 side via the tenth line 133*j* and the ninth line 133*i* (first relay line) without flowing through the above-mentioned coils 131*e* and 132*e*. Further, the fourth diode 134*d* prevents the current accumulated in the capacitor 135 from flowing directly to the second switch contact point 114 side via the tenth line 133*j* and the ninth line 133*i* (first relay line and fifth relay line) without flowing through the above-mentioned coils 131*e* and 132*e*.

After that, when the operation switch is operated so that the operation position becomes the window opening position, a current flows through the path illustrated in FIG. 23, and accordingly the window glass W is opened. Further, when the operation switch is operated so that the operation position becomes the window closing position, a current flows through the path illustrated in FIG. 22, and accordingly the window glass W is closed. As described above, in this embodiment, without using the ECU or integrated circuit, the window glass W is automatically opened and closed, and the window glass W is automatically reversely operated when the pinching is detected.

As described above, the object pinching detection unit 6 of the window regulator device of this embodiment includes the worm wheel 61 rotatable by the force of the electric motor 2, the output-side rotational member (driven plate 63 and object pinching detection plate 65), which is coupled to the output shaft 3 so as to be integrally rotatable and axially movable and is arranged coaxially with the worm wheel 61 so as to face the worm wheel 61, the drive force transmission spring 62 interposed between the worm wheel 61 and the driven plate 63 so as to transmit the rotational drive force of the worm wheel 61 to the output-side rotational member when the worm wheel 61 rotates in the X direction of FIGS. 3 and 5 so that the window glass W is closed, the cam means (protruding pieces 612 and protruding pieces 652) formed on the opposed surfaces of the worm wheel 61 and the output-side rotational member (upper end surface of the outer peripheral wall portion 61*a* of the worm wheel 61 and lower surface of the object pinching detection plate 65) so that, when the worm wheel 61 rotates in the X direction relative to the output-side rotational member, the object pinching detection plate 65 is axially movable along with the relative rotation, and the object pinching detection switch 66 for performing the switching operation based on the axial movement of the object pinching detection plate 65.

According to this embodiment, when the foreign object is pinched between the window glass W and the window frame, the worm wheel 61 rotates in the X direction of FIGS. 3 and 5 relative to the object pinching detection plate 65. At the time of the relative rotation, the protruding pieces 612 and the protruding pieces 652 respectively formed on the opposed surfaces of the worm wheel 61 and the object pinching detection plate 65 engage with each other. Through the engagement, the object pinching detection plate 65 axially moves. At this time, the object pinching detection plate 65 axially moves without rotation, and hence the object pinching detection plate 65 is brought into contact with the movable piece 663 of the object pinching detection switch 66 without rotation. Therefore, the wear due to rotation does not occur when the object pinching detection plate 65 and the object pinching detection switch 66 are brought into contact with each other. Thus, the deterioration in object pinching detection accuracy due to the wear is prevented. Further, the object pinching detection plate 65 axially moves without rotation, and hence the axial movement of the object pinching detection plate 65 does not need to be detected over the circumferential direction of the object pinching detection plate 65. Thus, there can be used a compact object pinching detection switch 66 that performs the switching operation based only on the axial movement of the object pinching detection plate 65.

Further, the object pinching detection unit 6 of this embodiment includes, as the cam means for axially moving the object pinching detection plate 65, the protruding pieces 612 formed into a projecting shape along the circumferential direction of the worm wheel 61 and provided on the upper end surface of the outer peripheral wall portion 61*a* of the worm wheel 61, and the protruding pieces 652 formed into a projecting shape along the circumferential direction of the object pinching detection plate 65 and provided on the lower surface of the object pinching detection plate 65. The protruding pieces 612 and the protruding pieces 652 are arranged and formed so as to engage with each other when the worm wheel 61 rotates in the X direction of FIGS. 3 and 5 relative to the object pinching detection plate 65. Further, the tapered surfaces 612*a* and 652*a* inclined relative to the X direction are formed in the protruding piece 612 and the protruding piece 652, respectively, so that the object pinching detection plate 65 is axially movable at the time of engagement between the protruding piece 612 and the protruding piece 652. Therefore, at the time of engagement between the protruding piece 612 and the protruding piece 652, the counterpart member slides along the tapered surface, and accordingly the object pinching detection plate 65 is axially moved reliably.

Further, a plurality of (in this embodiment, four) protruding pieces 612 having the same shape are provided along the circumferential direction of the worm wheel 61, and a plurality of protruding pieces 652 having the same shape, which are equal in number (four) to the protruding pieces 612, are provided along the circumferential direction of the object pinching detection plate 65. When the worm wheel 61 rotates in the X direction relative to the object pinching detection plate 65, all the protruding pieces 612 simultaneously engage with all the protruding pieces 652. Therefore, the object pinching detection plate 65 axially moves while maintaining the horizontal state without being inclined in the circumferential direction. Thus, the switching operation of the object pinching detection switch 66 is prevented from becoming unstable when the object pinching detection plate 65 axially moves while being inclined, with the result that the deterioration in object pinching detection accuracy is prevented.

Further, the plurality of protruding pieces 612 are disposed at regular intervals in the circumferential direction of the worm wheel 61, and the plurality of protruding pieces 652 are disposed at regular intervals in the circumferential direction of the object pinching detection plate 65. Therefore, when the protruding pieces 612 and the protruding pieces 652 engage with each other, the object pinching detection plate 65 axially moves at constant speed over the circumferential direction. Thus, the horizontal state at the time of axial movement can further be maintained.

Further, the output-side rotational member includes the driven plate 63, which is coupled to the output shaft 3 so as to be integrally rotatable and axially immovable and is configured to receive the rotational drive force of the worm wheel 61 via the drive force transmission spring 62 when the worm wheel 61 rotates in the X direction of FIGS. 3 and 5, and the object pinching detection plate 65 coupled to the driven plate 63 so as to be integrally rotatable and axially movable. Further, the protruding pieces 652 are formed on the object pinching detection plate 65. As described above, the output-side rotational member is formed of an assembly of the member for transmitting the rotational drive force from the worm wheel 61 to the output shaft 3 (driven plate 63) and the member axially movable at the time of pinching (object pinching detection plate 65). Accordingly, the output-side rotational member can be manufactured at relatively low cost.

Further, the object pinching detection switch 66 includes the first conductive portion 662*a* and the second conductive portion 662*b* formed on the substrate 661, and the movable piece 663. Further, the object pinching detection switch 66 is disposed at such a position that the contact state between the movable piece 663 and the second conductive portion 662*b* changes depending on the axial movement of the object pinching detection plate 65. Such a simple object pinching detection switch 66 enables easy detection of the pinching of the foreign object based on the axial movement of the object pinching detection plate 65.

Further, the window regulator device of this embodiment includes the drive circuit 100 connected to the electric motor 2 and having formed therein the energization path from the electric power source to the electric motor 2. The drive circuit 100 includes the first switch contact point 113, the second switch contact point 114, the first latching relay 131, the second latching relay 132, the first relay line (ninth line 133*i* and tenth line 133*j*), the second relay line (fifth line 133*e*), the third relay line (switch line 121 and sixth line 133*f*), the fourth relay line (seventh line 133*g* and eighth line 133*h*), and the object pinching detection switch 66. The first relay line connects the first output terminal 113*c* of the first switch contact point 113 to the first connection lead wire 131*g* of the first latching relay 131 and the second connection lead wire 132*g* of the second latching relay 132. The second relay line connects together the another end side of the first reverse rotation excitation coil 131*d* of the first latching relay 131 and the another end side of the second reverse rotation excitation coil 132*d* of the second latching relay 132. The third relay line connects the second relay line to the second output terminal 114*c* of the second switch contact point 114. The fourth relay line connects the first output terminal 113*c* to the another end side of the first forward rotation excitation coil 131*e* of the first latching relay 131 and the another end side of the second forward rotation excitation coil 132*e* of the second latching relay 132. The object pinching detection switch 66 is interposed in the third relay line (switch line 121), and performs the switching operation so as not to be brought into conduction when the foreign object is not pinched between the window glass and the window frame and so as to be brought into conduction when the foreign object is pinched between the window glass and the window frame.

According to the drive circuit 100 of this embodiment, when the operation position of the operation switch for operating opening and closing of the window glass is the window closing position, a current flows from the first electric power supply terminal 2*a* toward the second electric power supply terminal 2*b* of the electric motor 2, and hence the electric motor 2 rotates in the forward direction. Through the forward rotation of the electric motor, the window glass is closed. Further, when the operation position of the operation switch is the window opening position, a current flows from the second electric power supply terminal 2*b* toward the first electric power supply terminal of the electric motor 2, and hence the electric motor 2 rotates in the reverse direction. Through the reverse rotation of the electric motor 2, the window glass is opened.

Further, when the foreign object is pinched between the window glass and the window frame at the time of closing the window glass, the object pinching detection switch 66 is brought into the conductive state (ON state), and hence both the ends of the switch line 121 are brought into conduction under a condition in which the switching states of the other switches 75 and 76 are also the conductive state. Therefore, there is formed a relay circuit connecting the first switch contact point 113 (first output terminal 113*c*), the first relay line (ninth line 133*i* and tenth line 133*j*), the first reverse rotation excitation coil 131*d* and the second reverse rotation excitation coil 132*d*, the second relay line (fifth line 133*e*), the third relay line (switch line 121 and sixth line 133*f*), and the second switch contact point 114 (second output terminal 114*c*). Thus, a current flows from the positive terminal PT of the electric power source via the above-mentioned energization path to the negative terminal NT of the electric power source. Accordingly, the first reverse rotation excitation coil 131*d* and the second reverse rotation excitation coil 132*d* are energized, and the switching states of the first and second latching relays 131 and 132 are switched from the normal state to the reverse state. Through the switching operation of the latching relays as described above, the direction of energization of the electric motor 2 is reversed. That is, when the pinching is detected, the window glass is opened even in a case where the operation position of the operation switch is the window closing position. Accordingly, the pinching is eliminated.

As described above, according to this embodiment, the object pinching detection switch 66 is integrated into the drive circuit 100, and the drive circuit 100 is configured so that the latching relays are switched based on the conductive/non-conductive states of the object pinching detection switch 66. Thus, without using the integrated circuit or ECU, the opening and closing operation of the window glass is performed and the reverse operation is performed at the time of anti-pinch processing. Accordingly, a small-size, inexpensive drive circuit of the electric motor with which the anti-pinch processing is executable is provided.

Further, the drive circuit 100 of this embodiment includes the connection line (eleventh line 133*k*) electrically connecting the first relay line (tenth line 133*j*) to the negative terminal NT side of the electric power source, the capacitor 135 interposed in the connection line, and the third diode 134*c*, which is mounted onto the first relay line between the location connected to the connection line and the location connected to the first output terminal 113*c*, and blocks a current flowing from the side connected to the connection line toward the side connected to the first output terminal 113*c*. Thus, at the time of closing the window glass, the capacitor 135 interposed in the connection line is charged by a current flowing from the first output terminal 113*c* via the first relay line (ninth line 133*i* and tenth line 133*j*) to the connection line (eleventh line 133*k*). Further, when the operation of the operation switch is stopped at the time of the reverse operation (opening operation) of the window glass performed through the detection of the pinching, the electricity accumulated in the capacitor 135 is discharged. The discharge current flows through the connection line, the first relay line (tenth line 133*j*), the first forward rotation excitation coil 131*e* and the second forward rotation excitation coil 132*e*, and the fourth relay line (seventh line 133*g* and eighth line 133*h*), the first output terminal 113*c* side of the first switch contact point 113, to the negative terminal NT side of the electric power source. Accordingly, the first forward rotation excitation coil 131*e* and the second forward rotation excitation coil 132*e* are energized, and the switching states of the latching relays 131 and 132 are switched from the reverse state to the normal state. That is, the switching states of the latching relays 131 and 132 are recovered to the original switching state. After that, when the operation position of the operation switch becomes the window closing position, the window glass is closed, and when the operation position of the operation switch becomes the window opening position, the window glass is opened. As described above, according to the present embodiment, the recovery of the opening and closing operation of the window glass after the anti-pinch processing (recovery of the switching states of the latching coils to the normal state) is automatically performed through the discharge of the capacitor 135. Note that, at the time of discharging the capacitor 135, the third diode 134*c* prevents the discharge current from flowing directly to the first switch contact point 113 side through the first relay line.

Further, the second diode 134*b*, which blocks a current flowing from the side connected to the first output terminal 113*c* toward the side connected to the another end side of the first forward rotation excitation coil 131*e* and the another end side of the second forward rotation excitation coil 132*e*, is mounted onto the fourth relay line (eighth line 133*h*). When the pinching is detected, the second diode 134*b* blocks a current flowing from the fourth relay line toward the second relay line.

Further, the first diode 134*a*, which blocks a current flowing from the side connected to the second output terminal 114*c* via the switch line 121 toward the side connected to the second relay line (fifth line 133*e*), is mounted onto the third relay line (sixth line 133*f*). The first diode 134*a* prevents a current, which is supplied from the electric power source at the time of the reverse operation due to the pinching, from flowing from the third relay line to the second relay line side.

Further, the drive circuit 100 of this embodiment includes the fifth relay line (part of the ninth line 133*i*) connecting the first relay line and the second output terminal 114*c* to each other. The fourth diode 134*d*, which blocks a current flowing from the side connected to the first relay line toward the side connected to the second output terminal 114*c*, is mounted onto the fifth relay line. The fourth diode prevents a short circuit of a current at the time of closing the window glass. Further, at the time of discharging the capacitor 135, the fourth diode prevents the discharge current from flowing directly to the second switch contact point 114 side through the first relay line.

Further, the insensitive area detection switch 75 and the reverse operation area detection switch 76 serving as a position detection switch are interposed in the third relay line (switch line 121) in addition to the object pinching detection switch 66. The insensitive area detection switch 75 detects whether or not the open/close position of the window glass is situated within the insensitive area. The reverse operation area detection switch 76 detects whether or not the open/close position of the window glass is situated within the reverse operation area. Thus, when all the switches are brought into the conductive state, that is, when the pinching is detected and the open/close position of the window glass is situated out of the insensitive area and within the reverse operation area, the anti-pinch processing is executed.

Further, the first relay line (ninth line 133*i*) and the fourth relay line (seventh line 133*g*) are connected to the first output terminal 113*c* via the first line 133*a*. Similarly, the third relay line (sixth line 133*f*) and the fifth relay line (ninth line 133*i*) are connected to the second output terminal 114*c* via the second line 133*b*. In this manner, the electric power supply line and the relay line are shared as described above. Thus, the lines can be reduced and the manufacturing cost can further be reduced.

The present invention should not be interpreted as being limited to the above-mentioned embodiment. For example, in the above-mentioned embodiment, the output-side rotational member is formed of the driven plate 63 and the object pinching detection plate 65, but may alternatively be formed of a single rotational member. In this case, for example, the single output-side rotational member only needs to be coupled to the output shaft by spline fitting or the like, so as to be integrally rotatable and axially movable.

Figure 28A:
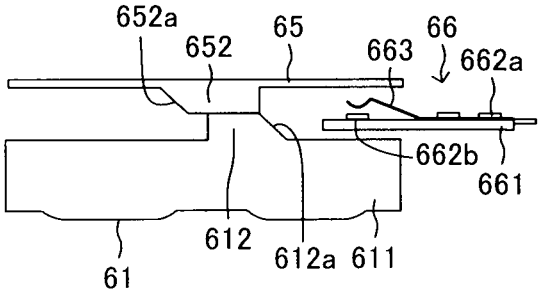
FIG. 28A is a view illustrating a modified example of cam means.
Figure 28B:
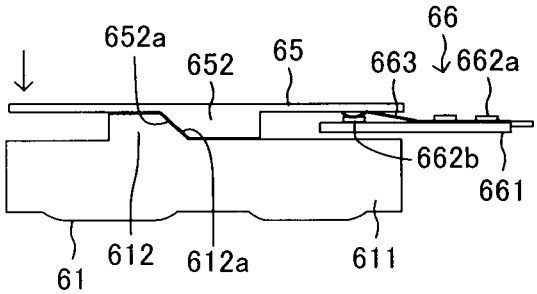
FIG. 28B is a view illustrating the modified example of the cam means.

Further, in the above-mentioned embodiment, there has been described an example in which, at the time of pinching of the foreign object, the object pinching detection plate 65 axially moves in the direction in which the object pinching detection plate 65 is spaced apart from the worm wheel 61. Alternatively, at the time of pinching of the foreign object, the object pinching detection plate 65 may axially move in a direction in which the object pinching detection plate 65 approaches the worm wheel 61. In this case, for example, as illustrated in FIG. 28A, the worm wheel 61 and the object pinching detection plate 65 are arranged so that, when the foreign object is not pinched (when the worm wheel 61 and the object pinching detection plate 65 integrally rotate in synchronization), a tip side edge of the protruding piece 612 and a tip side edge of the protruding piece 652 are brought into contact with each other. When the foreign object is pinched and therefore the worm wheel 61 rotates relative to the object pinching detection plate 65, the protruding piece 652 descends along the tapered surface 612*a* of the protruding piece 612 (see FIG. 28B). Accordingly, the object pinching detection plate 65 can be axially moved in the direction in which the object pinching detection plate 65 approaches the worm wheel 61.

Further, in the above-mentioned embodiment, there has been described an example in which the tapered surfaces 612*a* and 652*a* are formed in both the protruding piece 612 and the protruding piece 652, but the tapered surface only needs to be formed in at least one of those protruding pieces. When the tapered surface is formed in one of those protruding pieces, at the time of engagement between the protruding pieces 612 and 652, the counterpart member moves while sliding along the tapered surface formed in one of those protruding pieces, and accordingly the object pinching detection plate 65 can be axially moved.

Figure 29A:
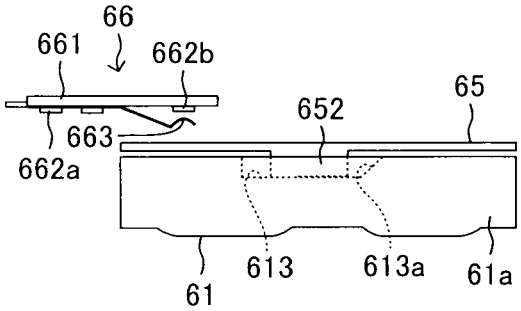
FIG. 29A is a view illustrating another modified example of the cam means.
Figure 29B:
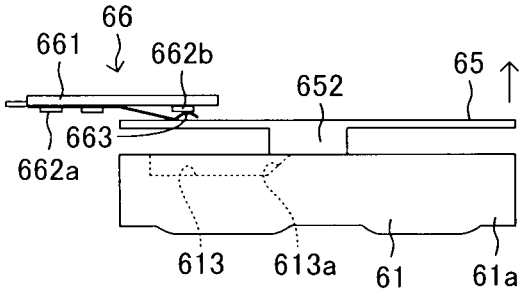
FIG. 29B is a view illustrating the another modified example of the cam means.

Further, in the above-mentioned embodiment, there has been described an example in which the protruding piece 612 and the protruding piece 652 formed into a projecting shape are used as the cam means for axially moving the object pinching detection plate 65. Alternatively, a recessed portion formed into a recessed shape may be used as the cam means. In this case, for example, as illustrated in FIG. 29A, a recessed portion 613 having one end surface as a tapered surface 613*a* is formed in the upper end surface of the outer peripheral wall portion 61*a* of the worm wheel 61. When the foreign object is not pinched, the protruding piece 652 is arranged in the recessed portion 613 (see FIG. 29A). When the foreign object is pinched and therefore the worm wheel 61 rotates relative to the object pinching detection plate 65, the protruding piece 652 overrides the tapered surface 613*a* of the recessed portion 613 (see FIG. 29B). With this structure as well, the object pinching detection plate 65 can be axially moved.

Further, in the above-mentioned embodiment, the arm-type window regulator device has been described as an example, but a cable-type window regulator device or other such window regulator device may be employed alternatively. Note that, in a case where the window regulator device is not the arm-type window regulator device, the moment acting on the output shaft does not change depending on the rotational position of the lift arm. Thus, the erroneous detection of the pinching due to the change in moment does not occur, and hence the cam 72*a* on the second gear 72 and the reverse operation area detection switch 76, which are provided in order to prevent an erroneous operation due to the erroneous detection, may be omitted. Further, in the above-mentioned embodiment, the window regulator device for opening and closing the window glass provided to the side window of the vehicle has been described as an example, but the window regulator device according to the present invention is also applicable as a device for automatically opening and closing a window glass provided to a roof window of the vehicle or other such window glass.

Figure 30:
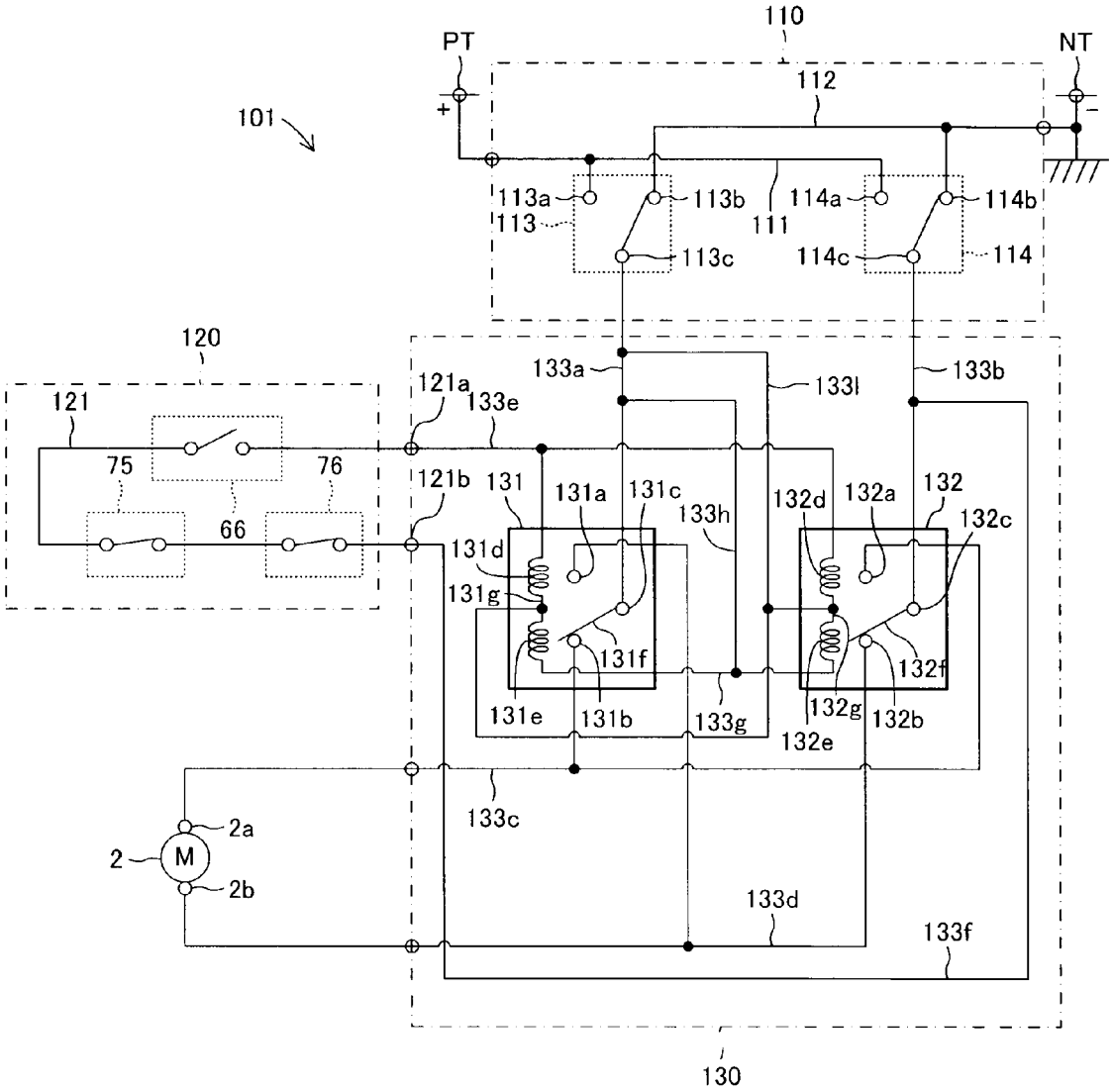
FIG. 30 is a diagram illustrating a modified example of the drive circuit.

Further, in the above-mentioned embodiment, the recovery of the switching states of the latching relays after the anti-pinch processing is performed through the discharge of the capacitor. In a case where such a recovery operation of the latching relays is not taken into consideration, a drive circuit 101 illustrated in FIG. 30 may be employed.

The drive circuit 101 is formed by omitting, from the drive circuit 100 described in the above-mentioned embodiment, the eleventh line 133*k*, the capacitor 135, the first diode 134*a*, the second diode 134*b*, the third diode 134*c*, and the fourth diode 134*d*, and providing a single relay line 133*l* (first relay line) in place of the ninth line 133*i* and the tenth line 133*j*. The relay line 133*l* is connected on one end side thereof to the first output terminal 113*c*, and is branched on another end side thereof. One of the branched lines is connected to the first connection lead wire 131*g*, and another of the branched lines is connected to the second connection lead wire 132*g*. Also in the case of using such a drive circuit 101, the window glass can be opened and closed in response to the operation of the operation switch, and when the pinching has occurred, the switching states of the latching relays are switched from the normal state to the reverse state, with the result that the window glass can be reversely operated. Note that, in order to recover the switching states of the latching relays from the reverse state to the normal state, the operation of the operation switch is stopped, and the first forward rotation excitation coil 131*e* of the first latching relay 131 and the second forward rotation excitation coil 132*e* of the second latching relay 132 are energized by the electric power source separately. Accordingly, both the latching relays are switched from the reverse state to the normal state.

Further, the eleventh line 133*k* and the capacitor 135 as illustrated in FIG. 21 may be added to the drive circuit 101, and a diode, which blocks a current flowing from one end side thereof (side connected to the first output terminal 113*c*) to another end side thereof (side connected to the first connection lead wire 131*g* and the second connection lead wire 132*g*) (this diode corresponds to the third diode 134*c* of the above-mentioned embodiment), may be provided to the relay line 133*l*. Through the addition of those components, as described in the above-mentioned embodiment, the switching states of the latching relays can be automatically recovered from the reverse state to the normal state after the anti-pinch processing.

As described above, the present invention may be modified without departing from the scope of the present invention.

The invention claimed is:

1. A window regulator device, comprising:

a power source;

an output shaft connected to the power source and rotatable by a force generated by the power source;

a drive force transmission mechanism for transmitting the force to a window glass of a vehicle so as to open and close the window glass; and an object pinching detection unit for detecting whether or not a foreign object is pinched between the window glass and a window frame, a position detection unit for detecting a position of the window glass relative to the window frame, wherein the object pinching detection unit comprises:

an input-side rotational member rotatable by the force of the power source;

an output-side rotational member coupled to the output shaft so that the output-side rotational member is integrally rotatable with the output shaft and axially movable relative to the output shaft, the output-side rotational member arranged coaxially with the input-side rotational member so as to face the input-side rotational member;

an elastic member interposed between the input-side rotational member and the output-side rotational member so as to transmit a rotational drive force of the input-side rotational member to the output-side rotational member when the input-side rotational member rotates in one rotational direction;

a cam formed respectively on opposed surfaces of the input-side rotational member and the output-side rotational member so that, when the input-side rotational member rotates in the one rotational direction relative to the output-side rotational member, the output-side rotational member is axially moved by said cams; and an object pinching detection switch for performing a switching operation based on the axial movement of the output-side rotational member, and wherein the position detection unit comprises:

an insensitive area detection switch which detects whether or not the position of the window glass is in an insensitive area which is immediately before the window glass is closed;

a reverse operation area detection switch which detects whether or not the position of the window lass is in a predetermined reverse operation area; and an operation lever which is rotatably supported by the output shaft, and wherein the insensitive area detection switch and the reverse operation area detection switch are switched by the rotation of the operation lever.

2. A window regulator device according to claim 1, wherein the:

input-side rotational member cam comprises a projection portion extending along a circumferential direction of the input-side rotational member and provided on the surface of the input-side rotational member opposed to the surface of the output-side rotational member; and the output-side rotational member cam comprises a projection portion extending along a circumferential direction of the output-side rotational member and provided on the surface of the output-side rotational member opposed to the surface of the input-side rotational member, wherein the input-side rotational member projection portion and the output-side rotational member projection portion are arranged and formed so as to engage with each other when the input-side rotational member rotates in the one rotational direction relative to the output-side rotational member, and wherein the output-side rotational member is axially moved when the input-side rotational member projection portion and the output-side rotational member projection portion engage with each other.

3. A window regulator device according to claim 2, wherein the input-side rotational member projection portion comprises a plurality of said input-side rotational member projection portions, and said output-side rotational member projection portion comprises a plurality of said output-side rotational member projection portions, the plurality of said output-side rotational member projection portions being equal in number to the plurality of said input-side rotational member projection portions, and wherein the plurality of said input-side rotational member projection portions and the plurality of said output-side rotational member projection portions are disposed so that, when the input-side rotational member rotates in the one rotational direction relative to the output-side rotational member, the plurality of said input-side rotational member projection portions simultaneously engage with the plurality of said output-side rotational member projection portions.

4. A window regulator device according to claim 3, wherein the plurality of said input-side rotational member projection portions are disposed at regular intervals in the circumferential direction of the input-side rotational member, and the plurality of said output-side rotational member projection portions are disposed at regular intervals in the circumferential direction of the output-side rotational member.

5. A window regulator device according to claim 1, wherein the power source comprises an electric motor having a first electric power supply terminal and a second electric power supply terminal, the electric motor being configured to generate said force through energization of one of the first electric power supply terminal and the second electric power supply terminal, wherein the window regulator device further comprises a drive circuit connected to the electric motor and having formed therein an energization path from an electric power source to the electric motor, wherein the drive circuit comprises:

a first switch comprising:

a first high voltage side input terminal connected to a positive terminal of the electric power source;

a first low voltage side input terminal connected to a negative terminal of the electric power source; and a first output terminal to be selectively connected to the first high voltage side input terminal and the first low voltage side input terminal, the first high voltage side input terminal and the first output terminal being connected to each other when an operation switch for opening and closing the window glass is in a window closing position, the first low voltage side input terminal and the first output terminal being connected to each other when the operation switch is in a window opening position and when the operation switch is in a neutral position;

a second switch comprising:

a second high voltage side input terminal connected to the positive terminal of the electric power source;

a second low voltage side input terminal connected to the negative terminal of the electric power source; and a second output terminal to be selectively connected to the second high voltage side input terminal and the second low voltage side input terminal, the second high voltage side input terminal and the second output terminal being connected to each other when the operation switch is in the window opening position, the second low voltage side input terminal and the second output terminal being connected to each other when the operation switch is in the window closing position and when the operation switch is in said neutral position;

a first latching relay comprising:

a first reverse rotation excitation coil having one end thereof connected to one end of a first forward rotation excitation coil via by a first connection lead wire;

a first reverse rotation terminal connected to the second electric power supply terminal;

a first forward rotation terminal connected to the first electric power supply terminal;

a first movable terminal connected to the first output terminal; and a first movable piece configured to connect the first reverse rotation terminal and the first movable terminal to each other when the first reverse rotation excitation coil is energized, and configured to connect the first forward rotation terminal and the first movable terminal to each other when the first forward rotation excitation coil is energized;

a second latching relay comprising:

a second reverse rotation excitation coil having one end thereof connected to one end of a second forward rotation excitation coil via a second connection lead wire;

a second reverse rotation terminal connected to the first electric power supply terminal;

a second forward rotation terminal connected to the second electric power supply terminal;

a second movable terminal connected to the second output terminal; and a second movable piece configured to connect the second reverse rotation terminal and the second movable terminal to each other when the second reverse rotation excitation coil is energized, and configured to connect the second forward rotation terminal and the second movable terminal to each other when the second forward rotation excitation coil is energized;

a first relay line connecting the first output terminal to the first connection lead wire and the second connection lead wire;

a second relay line connected to another end of the first reverse rotation excitation coil and another end of the second reverse rotation excitation coil;

a third relay line connecting the second relay line to the second output terminal; and a fourth relay line connecting the first output terminal to another end of the first forward rotation excitation coil and another end of the second forward rotation excitation coil, and wherein the object pinching detection switch is interposed in the third relay line, and is configured to be brought into a non-conductive state when the foreign object is not pinched between the window glass and the window frame and brought into a conductive state when the foreign object is pinched between the window glass and the window frame.

6. A window regulator device according to claim 5, wherein the drive circuit further comprises:

a connection line connecting the first relay line to the negative terminal side of the electric power source;

a capacitor interposed in the connection line; and a diode, which is interposed in the first relay line between a connection of the first relay line to the connection line and a connection of the first relay line to the first output terminal, and blocks a current from flowing to the first output terminal.

7. A window regulator device according to claim 5, wherein the drive circuit further comprises a diode, which is interposed in the fourth relay line, and blocks a current from flowing to the first forward rotation excitation coil and the the second forward rotation excitation coil.

8. A window regulator device according to claim 5, wherein the drive circuit further comprises a diode, which is interposed in the third relay line, and blocks a current from flowing to the second relay line.

9. A window regulator device according to claim 5, wherein the drive circuit further comprises:

a fifth relay line connecting the first relay line and the second output terminal to each other; and a diode, which is interposed in the fifth relay line, and blocks a current flowing from the first relay line toward to the second output terminal.

* * * * *